US008038286B2

(12) United States Patent
Kadomatsu et al.

(10) Patent No.: US 8,038,286 B2
(45) Date of Patent: Oct. 18, 2011

(54) LIQUID REMOVAL APPARATUS, IMAGE FORMING APPARATUS AND LIQUID REMOVAL METHOD

(75) Inventors: Tetsuzo Kadomatsu, Kanagawa-ken (JP); Takashi Hirakawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 498 days.

(21) Appl. No.: 12/239,649

(22) Filed: Sep. 26, 2008

(65) Prior Publication Data

US 2009/0087211 A1 Apr. 2, 2009

(30) Foreign Application Priority Data

Sep. 28, 2007 (JP) ..... 2007-256723

(51) Int. Cl.
*B41J 2/01* (2006.01)

(52) U.S. Cl. ..... 347/103; 347/101; 347/22

(58) Field of Classification Search ..... 347/103, 347/101, 99, 88, 31, 32, 22, 29, 33
See application file for complete search history.

(56) References Cited

U.S. PATENT DOCUMENTS

| | | | | |
|---|---|---|---|---|
| 4,990,962 | A * | 2/1991 | Kishi | 399/233 |
| 2002/0025486 | A1 | 2/2002 | Nukada et al. | |
| 2004/0070656 | A1* | 4/2004 | May et al. | 347/103 |
| 2008/0236480 | A1* | 10/2008 | Furukawa et al. | 118/50 |

FOREIGN PATENT DOCUMENTS

| | | | |
|---|---|---|---|
| JP | 7-225516 | A | 8/1995 |
| JP | 2002-23504 | A | 1/2002 |

* cited by examiner

*Primary Examiner* — Manish S Shah
(74) *Attorney, Agent, or Firm* — Birch, Stewart, Kolasch & Birch, LLP

(57) ABSTRACT

A liquid removal apparatus which removes liquid on a base material, has; an absorbing member which absorbs and removes the liquid on the base material by making contact with or by approaching to the liquid; an internal rotating body which is disposed inside a hollow portion of the absorbing member and has an opening section in an outer circumferential surface of the internal rotating body; a pressure reducing device which reduces pressure of the hollow portion of the absorbing member, an internal rotating body drive device which causes the internal rotating body to rotate relatively with respect to the absorbing member; a movement device which causes relative movement of the base material with respect to the absorbing member and the internal rotating body; and an internal rotating body drive control device which controls the internal rotating body drive device.

13 Claims, 11 Drawing Sheets

LIQUID REMOVAL APPARATUS, IMAGE FORMING APPARATUS AND LIQUID REMOVAL METHOD

BACKGROUND OF THE INVENTION

1. Field of the Invention

The present invention relates to a liquid removal apparatus, an image forming apparatus and a liquid removal method, and more particularly, to technology for removing liquid from a base material.

2. Description of the Related Art

In the related art, image forming apparatuses such as an inkjet recording apparatus and liquid electrophotography apparatus are known in which an image is formed on an intermediate transfer body by means of a liquid such as ink, liquid toner, or the like, and the image is then transferred onto a recording medium. In an apparatus of this kind, it is not possible to obtain satisfactory transfer if surplus liquid component, such as ink solvent or the carrier liquid of the toner, remains on the intermediate transfer body during transfer from the intermediate transfer body to the recording medium, and therefore the liquid component present on the intermediate transfer body must be removed before transfer.

It is suitable to use a method which brings a roller having a porous member on the surface thereof into contact with the intermediate transfer body, as a method of removing liquid from the intermediate transfer body. Furthermore, a method has been proposed in which the liquid component on the surface of the roller is recovered by setting the interior of the roller to a negative pressure in order to improve the efficiency of liquid removal.

Japanese Patent Application Publication No. 7-225516 describes a liquid absorbing roller in which the interior of a porous absorbing roller member having a hollow structure, which is formed by a porous sleeve having ventilating holes, is supported and the liquid inside the porous absorbing roller is suctioned via the porous sleeve.

Moreover, Japanese Patent Application Publication No. 2002-23504 describes a method in which a shielding body having an opening is provided inside a roller comprising a porous member on the surface thereof, the roller on the outer side with respect to the fixed opening is rotated, the interior of the shielding body is set to a reduced pressure, and the liquid absorbed in the porous body is suctioned via the opening.

However, in the liquid absorbing roller described in Japanese Patent Application Publication No. 7-225516, the suctioning pressure is distributed over the whole internal wall of the porous absorbing roller, and therefore it is difficult to achieve efficient removal of the liquid. Furthermore, in the invention described in Japanese Patent Application Publication No. 2002-23504, since there is an excessively large relative speed differential between the opening and the internal wall of the roller during the high-speed printing operation in particular, then it is not possible to achieve a sufficient suctioning time and this leads to a decline in the suctioning efficiency.

SUMMARY OF THE INVENTION

The present invention has been contrived in view of the foregoing circumstances, an object thereof being to provide a liquid removal apparatus, an image forming apparatus and a liquid removal method whereby liquid on a base material can be removed efficiently.

In order to attain an object described above, one aspect of the present invention is directed to, a liquid removal apparatus which removes liquid on a base material, the liquid removal apparatus comprising: an absorbing member which has a hollow cylindrical shape, is composed to be able to rotate around an axis of rotation being a central axis of the hollow cylindrical shape, and absorbs and removes the liquid on the base material by making contact with or by approaching to the liquid; an internal rotating body which has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body; a pressure reducing device which is connected to the opening section of the internal rotation body and reduces pressure of the hollow portion of the absorbing member; an internal rotating body drive device which causes the internal rotating body to rotate relatively with respect to the absorbing member; a movement device which causes relative movement of the base material with respect to the absorbing member and the internal rotating body; and an internal rotating body drive control device which controls the internal rotating body drive device in such a manner that: number $N_1$ of rotations per unit time of the absorbing member (where $N_1 \neq 0$), number $N_2$ of rotations per unit time of the internal rotating body (where $N_1 \neq N_2$ and $N_2 \neq 0$), and a shortest time $T_1$ until an amount of the liquid absorbed by the absorbing member reaches an upper limit of a liquid absorbing capability of the absorbing member, satisfy a following relationship: $1/|N_1-N_2|>T_1$, and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship: $T_2>T_3$.

According to this aspect of the invention, it is possible to concentrate the suctional pressure created by the pressure reducing device at the opening section provided on the surface of the internal rotating body, and therefore the liquid absorbed by the absorbing member is removed efficiently from the interior of the absorbing member. Furthermore, since the rotation of the internal rotating body is controlled in such a manner that the opening section provided in the surface of the internal rotating body rotates through the full circumference of the absorbing member along the internal surface of the absorbing member within the time period ($T_1$) taken by the absorbing member to absorb the liquid until reaching the upper limit of its absorption capability, then it is possible to recover the liquid inside the absorbing member via the opening section in the internal rotating body, before the absorbing member becomes unable to absorb liquid.

Moreover, since control is implemented in such a manner that the opening section of the internal rotating body travels relatively past one point on the absorbing member within a time period which is less than the time period ($T_3$) taken for the liquid on the outer surface of the absorbing member to move to the inner surface of the absorbing member (in other words, in such a manner that the internal rotating body rotates through an angle corresponding to the opening angle $\alpha°$ of the opening section), then all of the liquid present between the outer surface and the inner surface of the absorbing member can be recovered via the opening section.

Desirably, the central axis of the absorbing member having the round hollow cylindrical shape is common to the central axis of the internal rotating body having the round cylindrical shape, and thereby the rotational axis of the absorbing member is common to the rotational axis of the internal rotating body. It is also possible to adopt a composition in which the absorbing member rotates idly in accordance with the relative movement with respect to the image forming medium.

A desirable mode is one where the planar shape of the opening section provided in the outer circumferential surface of the internal rotating body is a rectangular shape having longer edges in the lengthwise direction of the internal rotating body (the direction of the axis of rotation), or an elongated oval (ellipse) shape in which the longer axis direction coincides with the lengthwise direction.

The base material includes a medium, substrate, and the like, to which liquid is applied, and a material such as paper (and in particular, a non-permeable paper or paper of low permeability), metal, resin, or the like, is used.

Desirably, the liquid removal apparatus further comprises an absorbing member drive device which causes the absorbing member to rotate around the axis of rotation being the central axis of the hollow cylindrical shape, wherein the absorbing member drive device and the internal rotating body drive device are driven by means of a common drive source.

According to this aspect of the invention, it is possible to reduce the number of drive sources inside the apparatuses by causing the absorbing member and the internal rotating body to rotate by means of the same drive source.

A desirable mode is one where transmission devices having different gear ratios are coupled to the common drive source, one transmission device being included in the absorbing member drive device and the other transmission device being included in the internal rotating body drive device. It is possible to express the one gear ratio and the other gear ratio as $1/N_1:1/N_2$, using the number of rotations $N_1$ per unit time of the absorbing member and the number of rotations $N_2$ per unit time of the internal rotating body.

Desirably, the liquid removal apparatus further comprises a wiping member which is provided on the outer circumferential surface of the internal rotating body, and wipes an inner surface of the absorbing member.

According to this aspect of the invention, by wiping the inner surface of the absorbing member by means of the wiping member, a foamed liquid expelled from the interior of the absorbing member is wiped away and the liquid absorbed by the absorbing member is recovered with good efficiency.

A desirable mode is one in which the wiping member is disposed following the lengthwise direction of the internal rotating body in the vicinity of the opening. Furthermore, a desirable mode is one where wiping members are disposed on either side of the opening in terms of the direction of rotation of the internal rotating body.

A desirable mode is one where the length of the wiping member in the lengthwise direction of the internal rotating body (the direction of the axis of rotation) is the same as the length of the internal rotating body in the lengthwise direction. It is also possible to arrange a plurality of wiping members which are shorter than the length of the lengthwise direction of the internal rotating body through the length in the lengthwise direction of the internal rotating body.

Desirably, the plurality of wiping members have a length corresponding to a length in a lengthwise direction of the internal rotating body, and are provided on both sides of the opening section in terms of a direction of rotation of the internal rotating body.

According to this aspect of the invention, the space between the inner surface of the absorbing member and the opening section of the internal rotating body is sealed by the wiping members, and the pressure created by the pressure reducing device can be concentrated on the absorbing member. In other words, the wiping member functions as a sealing member.

Desirably, a gap is provided between an inner surface of the absorbing member and the outer circumferential surface of the internal rotating body.

According to this aspect of the invention, since the inner surface of the absorbing member and the outer circumferential surface of the internal rotating body do not make contact with each other, then there is no concern with regard to wearing of the absorbing member and the internal rotating body. Furthermore, it is possible to cause the absorbing member and the internal rotating body to rotate stably at a uniform speed of rotation.

In order to attain an object described above, another aspect of the present invention is directed to an image forming apparatus, comprising: an image forming liquid deposition device which deposits an image forming liquid on an image forming medium; an absorbing member which has a hollow cylindrical shape, is composed to be able to rotate around an axis of rotation being a central axis of the hollow cylindrical shape, and absorbs and removes a liquid component on the image forming medium by making contact with or approaching to the liquid component; an internal rotating body which has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body; a pressure reducing device which is connected to the opening section of the internal rotation body and reduces pressure of the hollow portion of the absorbing member; an internal rotating body drive device which causes the internal rotating body to rotate relatively with respect to the absorbing member; a movement device which causes relative movement of the image forming medium with respect to the absorbing member and the internal rotating body; and an internal rotating body drive control device which controls the internal rotating body drive device in such a manner that: number $N_1$ of rotations per unit time of the absorbing member (where $N_1 \neq 0$), number $N_2$ of rotations per unit time of the internal rotating body (where $N_1 \neq N_2$ and $N_2 \neq 0$), and a shortest time $T_1$ until an amount of the liquid absorbed by the absorbing member reaches an upper limit of a liquid absorbing capability of the absorbing member, satisfy a following relationship: $1/|N_1-N_2|>T_1$, and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship: $T_2>T_3$.

According to this aspect of the invention, in image forming using an image forming liquid such as ink, wet toner (liquid toner), resist liquid, resin liquid, or the like, it is possible to remove surplus liquid (solvent component, developer liquid), and the like, which are remaining on the image forming medium, and hence decline in image quality due to remaining liquid can be avoided.

The image forming medium includes a medium on which a desired image or pattern is formed by depositing an image forming liquid, such as color ink, wet toner, resist liquid, resin layer, etc., and this includes paper (especially non-permeable paper or paper of low permeability), metal, resin, glass, and the like.

Desirably, the image forming apparatus further comprises a treatment liquid deposition device which deposits onto the image forming medium a treatment liquid which reacts with the image forming liquid to separate the image forming liquid into a liquid component and an aggregated or insolubilized component.

According to this aspect of the invention, in a two-liquid method which uses a treatment liquid having a function of aggregating or insolubilizing an image forming liquid, it is possible to remove the liquid component which has separated on the image forming medium, in a suitable fashion.

Desirably, the image forming liquid includes an ink containing a coloring material.

In this aspect of the invention, the ink includes a pigment-based ink in which pigment particles are dispersed in a solvent, and a dye-based ink in which a dye coloring material is dissolved in a solvent.

Desirably, the image forming apparatus further comprises a transfer recording device which transfers and records an image formed on the image forming medium, onto a recording medium.

According to this aspect of the invention, in an image forming apparatus which employs a transfer recording system, it is possible to remove the surplus liquid on the image forming medium efficiently before transferring and recording the primary image formed on the image forming medium (intermediate transfer body).

In order to attain an object described above, another aspect of the present invention is directed to a liquid removal method of removing liquid on a base material, the liquid removal method comprising the step of, while causing an internal rotating body to rotate relatively with respect to an absorbing member, causing relative movement of the base material with respect to the absorbing member and the internal rotating body, wherein: the absorbing member has a hollow cylindrical shape, is composed to be able to rotate around an axis of rotation being a central axis of the hollow cylindrical shape, and absorbs and removes the liquid on the base material by making contact with or by approaching to the liquid; the internal rotating body has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body; and the internal rotating body is controlled so that the relative movement of the base material with respect to the absorbing member and the internal rotating body is caused to remove the liquid on the base material while pressure of the hollow portion of the absorbing member is reduced via the opening section of the internal rotating body, in such a manner that: number $N_1$ of rotations per unit time of the absorbing member (where $N_1 \neq 0$), number $N_2$ of rotations per unit time of the internal rotating body (where $N_1 \neq N_2$ and $N_2 \neq 0$), and a shortest time $T_1$ until an amount of the liquid absorbed by the absorbing member reaches an upper limit of a liquid absorbing capability of the absorbing member, satins a following relationship: $1/|N_1-N_2|>T_1$, and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship: $T_2>T_3$.

According to this aspect of the invention, it is possible to remove the liquid on a base material efficiently, and therefore liquid removal processing can be carried out in a continuous fashion.

According to the present invention, it is possible to concentrate the suctional pressure created by the pressure reducing device at the opening section provided on the surface of the internal rotating body, and therefore the liquid absorbed by the absorbing member is removed efficiently from the interior of the absorbing member. Furthermore, since the rotation of the internal rotating body is controlled in such a manner that the opening section provided in the surface of the internal rotating body rotates through the full circumference of the absorbing member along the internal surface of the absorbing member within the time period ($T_1$) taken by the absorbing member to absorb the liquid until reaching the upper limit of its absorption capability, then it is possible to recover the liquid inside the absorbing member via the opening section in the internal rotating body, before the absorbing member becomes unable to absorb liquid.

Moreover, since control is implemented in such a manner that the opening section of the internal rotating body travels relatively past one point on the absorbing member within a time period which is less than the time period ($T_3$) taken for the liquid on the outer surface of the absorbing member to move to the inner surface of the absorbing member (in other words, in such a manner that the internal rotating body rotates through an angle corresponding to the opening angle $\alpha°$ of the opening section), then all of the liquid present between the outer surface and the inner surface of the absorbing member can be recovered via the opening section.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Liquid Removal Apparatus

Figure 1:
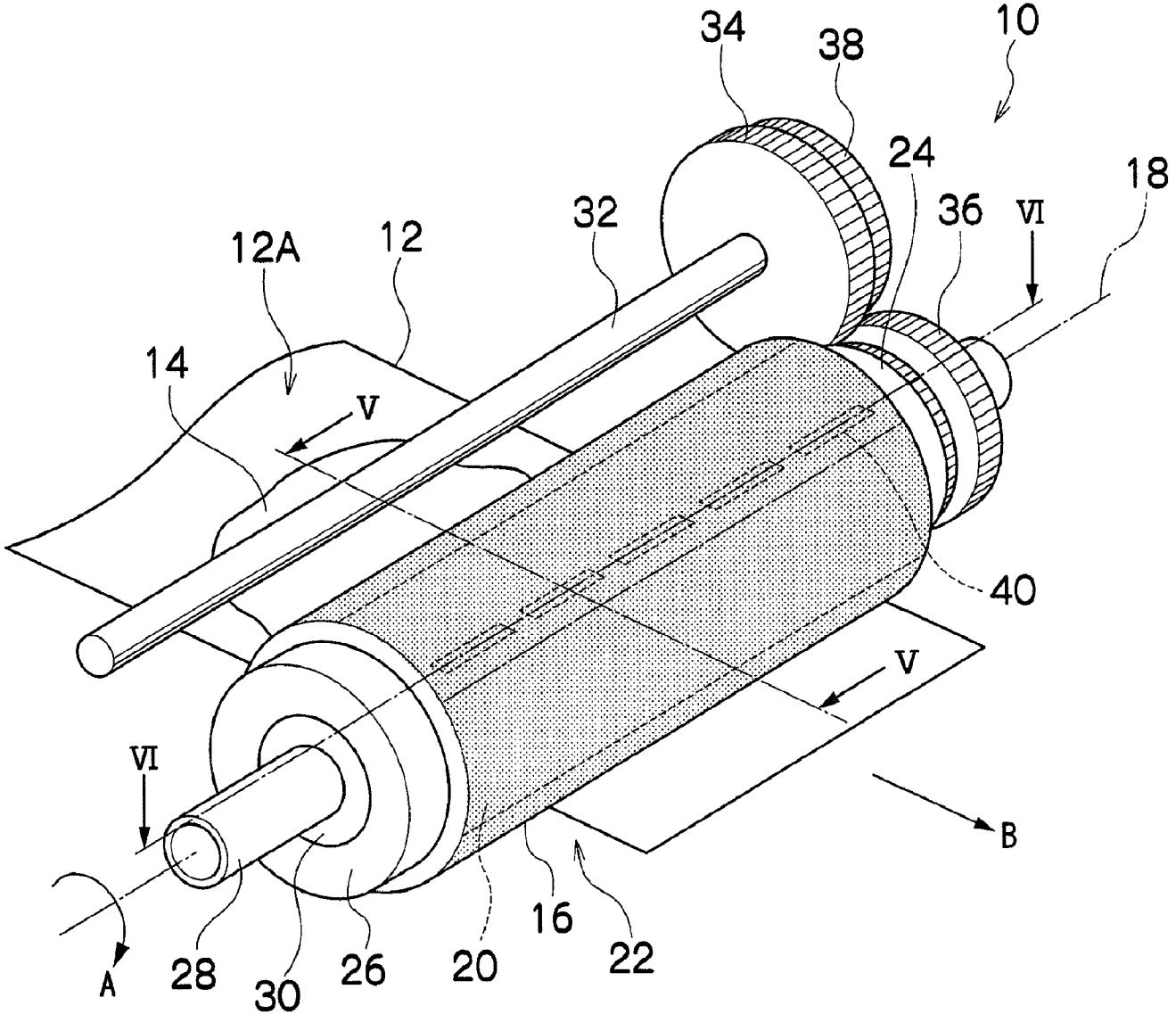
FIG. 1 is a general schematic drawing of a liquid removal apparatus relating to an embodiment of the present invention.

FIG. 1 is an oblique view showing the general composition of a liquid removal apparatus 10 relating to an embodiment of the present invention. The liquid removal apparatus 10 according to the present embodiment is suitable for use in a liquid removal process for removing surplus solvent (liquid component) which remains on a base material after forming an image by means of an image forming apparatus, such as an inkjet recording apparatus.

The liquid removal apparatus 10 illustrated in FIG. 1 is composed in such a manner that the unwanted liquid 14 present on the image forming surface 12A of an image forming medium 12 is suctioned and removed by a porous roller 16, by placing the porous roller 16 in contact with unwanted liquid 14 present on the image forming surface 12A of the image forming medium 12, as well as moving the image forming medium 12 in the direction of movement indicated by arrow B while rotating the porous roller 16 in the clockwise direction indicated by arrow A in FIG. 1 about the central axis 18 of the porous roller 16 (indicated by the single-dotted line).

The liquid removal apparatus 10 is provided with a liquid absorbing roller 22 comprising a hollow round cylindrical porous roller 16 and an internal rotating body 20 which is provided inside the porous roller 16 and has a round cylindrical shape that corresponds to the hollow round cylindrical shape of the porous roller 16. The porous roller 16 which has a hollow round cylindrical shape is supported at one end thereof in the lengthwise direction by means of a flange member 24, and is supported at the other end by means of a flange member 26. Moreover, the flange member 24 and the flange member 26 are supported via bearings on a shaft 28, the center of which forms the axis of rotation of the internal rotating body 20. In FIG. 1, the bearing for the flange member 24 is not shown in the illustration and only the bearing 30 for the flange member 26 is depicted. Moreover, the composition which supports the unified liquid absorbing roller 22 is omitted from the drawings.

A drive force transmission mechanism including a shaft 32 and a gear 34 is coupled to the flange member 24, and the flange member 24 can be rotated while in a state of supporting the porous roller 16, taking the central axis 18 of the porous roller 16 (shaft 28) as the axis of rotation, by the drive force of a motor (not illustrated) which is transmitted via the drive force transmission mechanism.

The internal rotating body 20 has a structure which is provided with the shaft 28 having an axis of rotation which coincides with the central axis of the round cylindrical shape (a central axis which coincides with the central axis 18 of the porous roller 16). Furthermore, a gear 36 is bonded to the shaft 28 and furthermore, the drive force transmission mechanism comprising a gear 38, and the shaft 28 is coupled to the drive force transmission mechanism including the gear 38 and the shaft 32 via this gear 36. The gear 38 of this drive force transmission mechanism is bonded to the shaft 32 which is common to the gear 34 included in the drive force transmission mechanism for the porous roller 16, in such a manner that it is rotated by the drive force of the motor which rotates the porous roller 16.

In the liquid removal apparatus 10 according to the present embodiment, the gear 34 of the drive force transmission mechanism for the porous roller 16 and the gear 38 of the drive force transmission mechanism for the internal rotating body 20 have different gear ratios, and when the shaft 32 rotates, the flange member 24 which is coupled to the gear 34, and the gear 36 and the shaft 28 which are coupled to the gear 38, rotate at different speeds of rotation in the same direction of rotation, and hence the porous roller 16 and the internal rotating body 20 rotate at different speeds of rotation in the same direction of rotation.

If the number of rotations (rotational speed) of the porous roller 16 per unit time (one minute) is taken to be $N_1$ (rpm), and the number of rotations (rotational speed) of the internal rotating body 20 per unit time is taken to be $N_2$ (rpm), then the relationship $N_1 \neq N_2$ is satisfied (where $N_1 \neq 0$ and $N_2 \neq 0$). The details are described hereinafter, but it is possible for the speed of rotation of the internal rotating body 20 to be slower than the speed of rotation of the porous roller 16 ($N_1 > N_2$), and it is also possible for the speed of rotation of the internal rotating body 20 to be faster than speed of rotation of the porous roller 16 ($N_1 < N_2$).

In the present embodiment, a mode is shown in which the porous roller 16 and the internal rotating body 20 are caused to rotate by means of one drive source (motor), but it is also possible for a motor which rotates the porous roller 16 and a motor which rotates the internal rotating body 20 to be provided respectively and separately. Furthermore, a desirable mode is one where a clutch mechanism is provided for each of the drive force transmission mechanisms, in order to adjust the respective rotation start points of the porous roller 16 and the internal rotating body 20, and to adjust the phase difference between the porous roller 16 and the internal rotating body 20.

The interior space of the porous roller 16 and the internal rotating body 20 are composed so that the diameter of the internal rotating body 20 is less than the internal diameter of the porous roller 16 (the diameter of the hollow space) (i.e. "the diameter of the internal rotating body 20"<"the internal diameter of the porous roller 16 (the diameter of the hollow space)"), in such a manner that the porous roller 16 and the internal rotating body 20 can be rotated in a stable fashion without the interior of the porous roller 16 making contact with the outer circumference of the internal rotating body 20.

To give one example of the external diameter $D_1$ and the internal diameter $D_2$ of the porous roller 16 used in the present embodiment, the values are $D_1$=70 mm and $D_2$=60 mm, and the thickness $t(=(D_1-D_2)/2)$ is 5 mm. The size of the porous roller 16 is governed by the size of the image forming medium used, and the maximum value of the surplus volume of liquid which remains on the image forming medium (for example, the liquid volume occurring when a solid image is formed over the whole surface of the image forming medium 12 in FIG. 1).

A plurality of opening sections 40 having a substantially rectangular shape are provided throughout the whole length in the lengthwise direction, of the outer circumferential surface of the internal rotating body 20 indicated by the dotted line in FIG. 1. Furthermore, although the detailed structure is described hereinafter, the opening sections 40 are connected to a pump, which is not illustrated. When the internal rotating body 20 is rotated relatively with respect to the porous roller 16 while driving the pump and reducing the pressure of the interior of the porous roller 16 via the opening sections 40, the liquid held of the porous roller 16 is recovered from the whole of the porous roller 16 during the internal rotating body 20

(opening sections 40) traveling about the whole inner circumference of the porous roller 16.

Although not shown in the drawings, an elevator mechanism which moves the liquid absorbing roller 22 in the upward and downward direction is provided in the liquid removal apparatus 10 illustrated in FIG. 1, thereby achieving a composition in which the distance between the image forming surface 12A of the image forming medium 12 and the outer circumferential surface of the liquid absorbing roller 22 (outer circumferential surface of the porous roller 16) can be altered.

Figure 2:
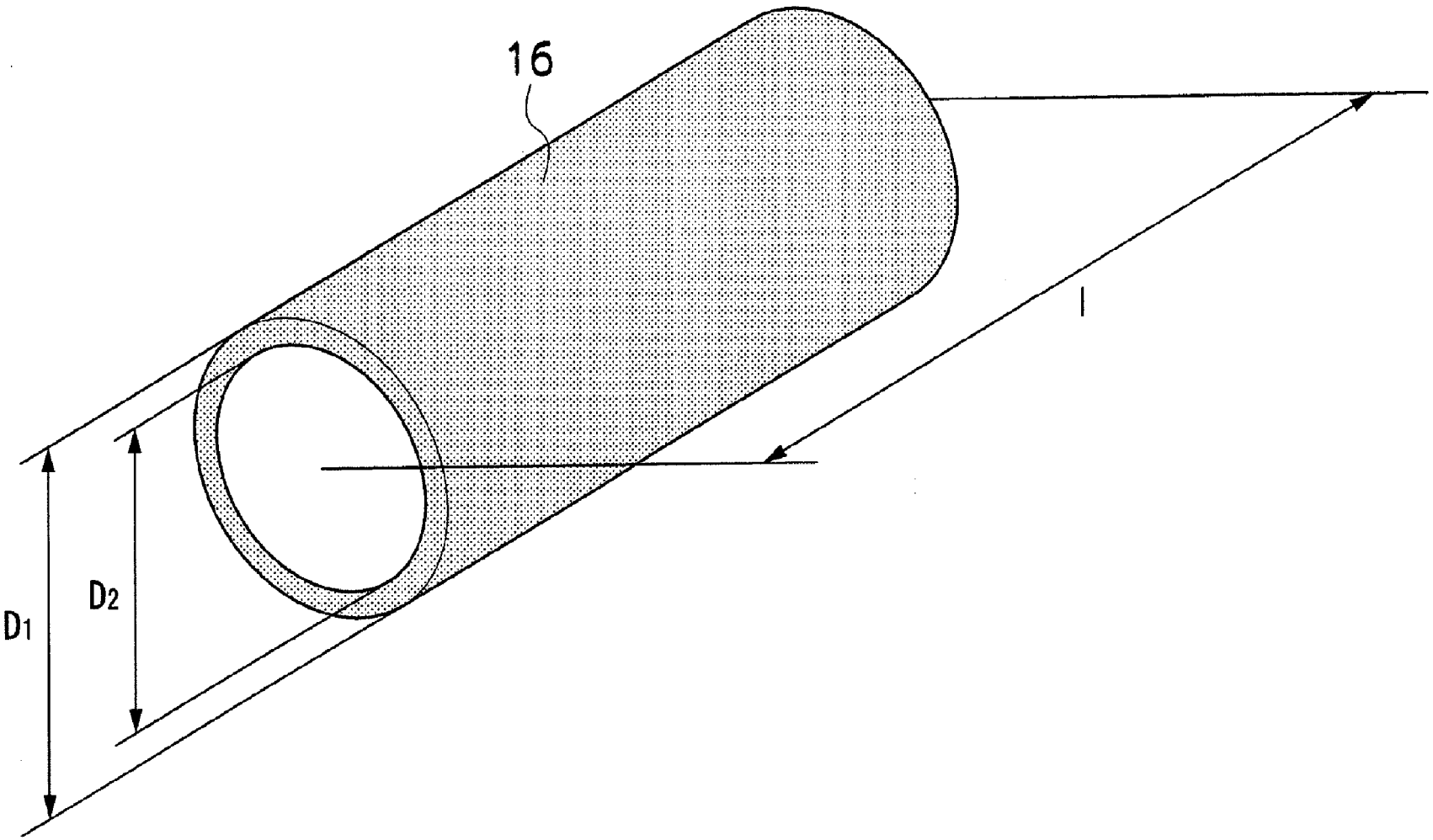
FIG. 2 is a perspective diagram of the porous roller illustrated in FIG. 1.

FIG. 2 shows the porous roller 16 alone. The length 1 of the porous roller 16 illustrated in FIG. 2 in the lengthwise direction thereof (the direction of the central axis) corresponds to the width of the image forming medium 12 illustrated in FIG. 1 (the length in the direction perpendicular to the direction of movement of the image forming medium). If the width of the image forming method 12 is taken as W, then the length 1 of the lengthwise direction of the porous roller 16 satisfies the relationship $1 \geqq W$.

For the porous roller 16, it is possible to use a ceramic porous material such as silicon carbide, alumina, silica, zirconia, titanium carbide, or the like, a metal porous material such as titanium or stainless steel, or a resin porous material such as polyethylene, polyurethane, or the like, but from the viewpoint of durability, processing accuracy, cost and the like, it is also suitable to use a sintered ceramic porous material such as silicon carbide or alumina in particular. From the perspective of the liquid absorption capability (absorption speed and absorption volume), it is desirable to use a porous material having an average pore diameter which is equal to or greater than 10 μm and equal to or less than 50 μm, and a void ratio which is equal to or more than 40% and equal to or lower than 70%. In the present example, a porous member made of silicon carbide (sintered ceramic) having an average pore diameter of 40 μm and a void ratio of 50% is used as the porous roller 16.

Figure 3:
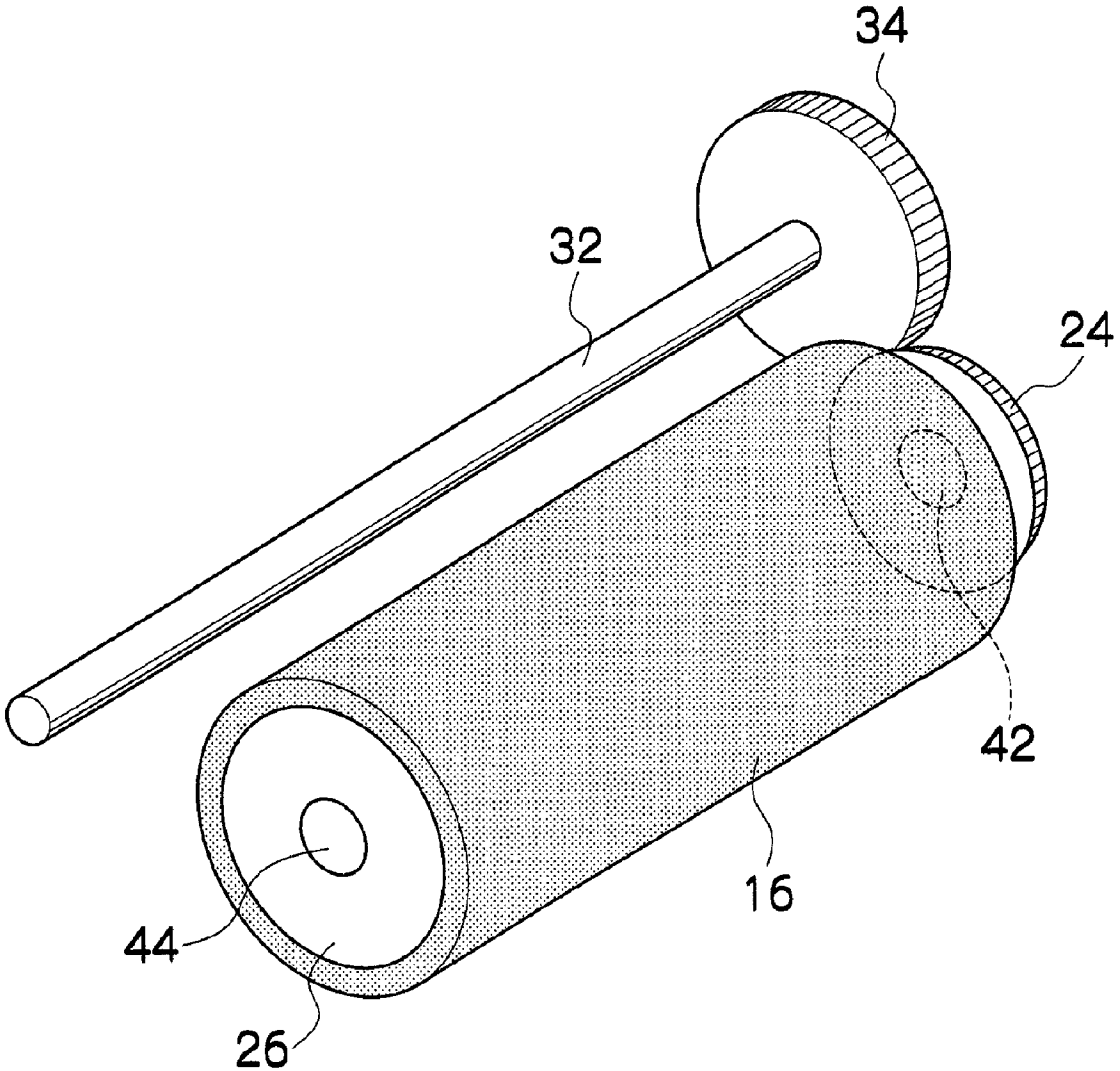
FIG. 3 is a perspective diagram of the porous roller and the drive mechanism illustrated in FIG. 1.

FIG. 3 shows the porous roller 16 and the drive force transmission mechanism for the porous roller 16. A bearing holding unit 42 which holds a bearing (reference numeral 31 in FIG. 4 and the like) is formed in the center of the flange member 24 which supports one end portion of the lengthwise direction of the porous roller 16 having a hollow round cylindrical shape, and furthermore a bearing holding unit 44 which holds a bearing (reference numeral 30 in FIG. 4) is formed in the center of the flange member 26 which supports the other end of the porous roller 16.

Figure 4:
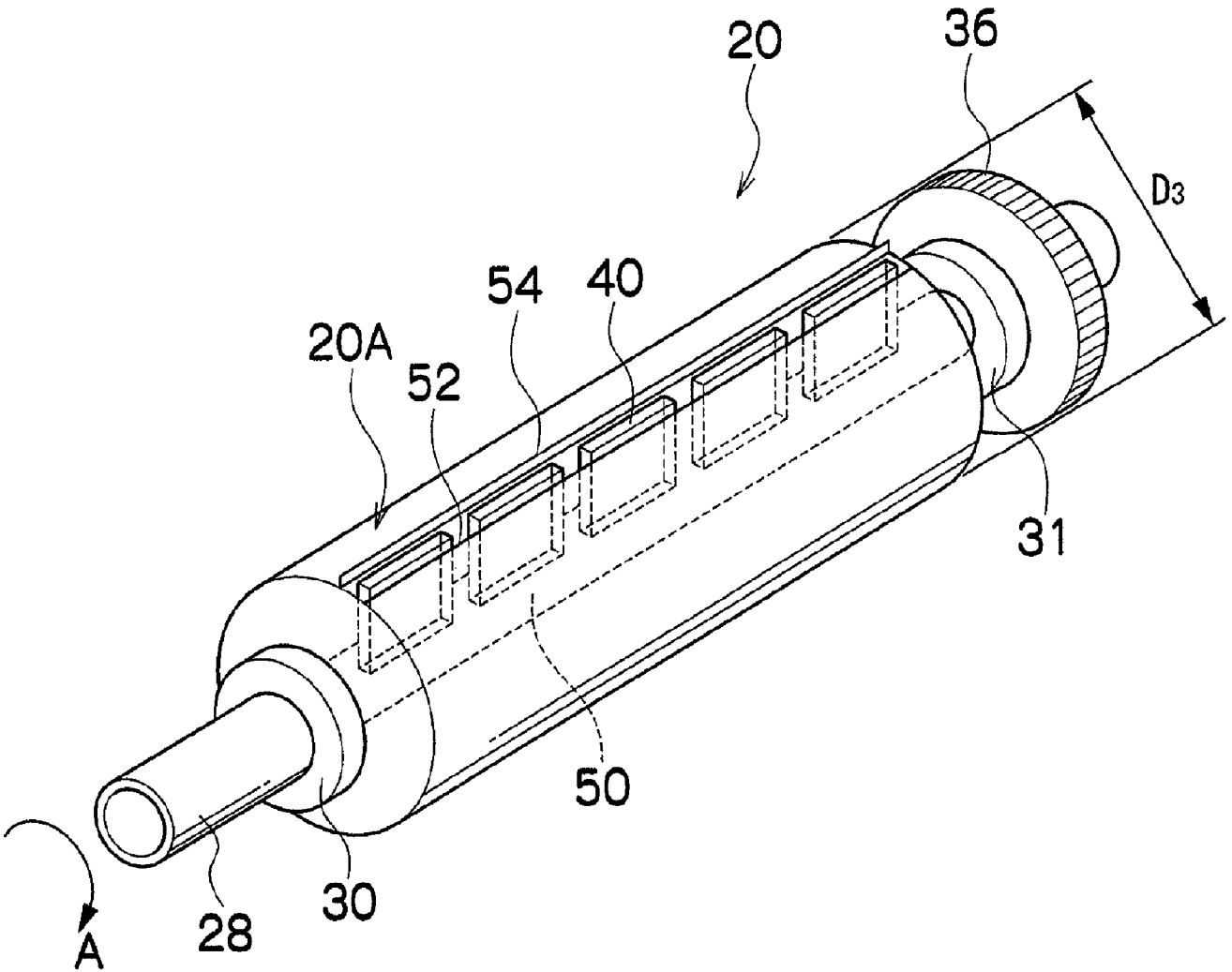
FIG. 4 is a perspective diagram of the internal rotating body illustrated in FIG. 1.

FIG. 4 shows the internal rotating body 20. The internal rotating body 20 is provided with the shaft 28 having an axis of rotation on the central axis of the internal rotating body 20, and the bearings 30 and 31 which are held by the bearing holding units 42 and 44 of the flange members 24 and 26 illustrated in FIG. 3 are bonded to the shaft 28, in addition to which the gear 36 is bonded to the outer side of the bearing on the side of the bearing 31. The diameter $D_3$ of the internal rotating body 20 is less than the internal diameter of the porous roller 16 is (reference numeral $D_2$ in FIG. 2).

Furthermore, a plurality of opening sections 40 are aligned equidistantly on the outer circumferential surface 20A of the internal rotating body 20, throughout the whole length in the lengthwise direction of the outer circumferential surface 20A of the internal rotating body 20, following the direction of the central axis of the internal rotating body 20 (lengthwise direction). The opening sections 40 illustrated in FIG. 4 have a substantially rectangular shape in the outer circumferential surface, and the longer edges of the rectangular shape are parallel to the lengthwise direction of the internal rotating body 20. The planar shape of the opening sections 40 may also be an elongated ellipse shape, or the like.

The opening sections 40 are connected to a reduced pressure space 50 which is provided in the shaft 28 and passes completely through the internal rotating body 20 in the lengthwise direction following the central axis of the internal rotating body 20. If a pump (not illustrated) which is connected to the reduced pressure space 50 is operated, then the interior of the porous roller 16 is set to a reduced pressure via the opening sections 40 and the reduced pressure space 50, and the liquid held inside the porous roller 16 is recovered via the opening sections 40 and the reduced pressure space 50. By providing opening sections 40 in a portion of the outer circumferential surface of the internal rotating body 20 in this way, it is possible to concentrate the negative pressure generated inside the porous roller 16 at the opening sections 40, and hence the liquid of the porous roller 16 can be recovered efficiently.

In the present example, a mode is described in which the plurality of opening sections 40 are arranged in one row and correspond to the whole length of the internal rotating body 20 in the lengthwise direction, but it is also possible to adopt a further mode of the opening section 40 in which only one rectangular-shaped opening having longer edges of a length that corresponds to the whole length of the internal rotating body 20 in the lengthwise direction. In other words, the opening section(s) 40 may also correspond to the full length of the internal rotating body 20 in the lengthwise direction, and the number of the opening section(s) 40 and the length of the opening section(s) 40 in the lengthwise direction which coincides with the central axis of the internal rotating body 20 can be decided appropriately. If a plurality of opening sections 40 are used, then since the portions between mutually adjacent opening sections 40 form regions where the pressure is not reduced (dead spaces), then it is desirable that the portions between the mutually adjacent opening sections 40 should be made as small as possible.

By providing the opening sections 40 in one portion of the outer circumferential surface of the internal rotating body 20 and reducing the pressure of the interior of the porous roller 16 via the opening sections 40, it is possible to concentrate the pressure generated by the pump at the position of the opening sections 40, and therefore the liquid held in the porous roller 16 can be recovered in a highly efficient manner.

If the space between the porous roller 16 and the internal rotating body 20 is large, then the suctional force is dispersed, and therefore from the viewpoint of concentrating the suctional force and from the viewpoint of the rotational stability of the porous roller 16 (see FIG. 1) and the internal rotating body 20, desirably, the outer diameter $D_3$ of the internal rotating body 20 should be equal to or greater than 95% and equal to or less than 99.5% of the inner diameter of the porous roller 16.

Moreover, blades 52 and 54 having a length corresponding to the full length in the lengthwise direction of the internal rotating body 20 are provided on either side of the opening sections 40 in terms of the direction of rotation A of the internal rotating body 20, following the direction of the central axis of the internal rotating body 20. The blades 52 and 54 have a height whereby they make contact with the interior of the porous roller 16 when the internal rotating body 20 is inserted into the hollow portion of the porous roller 16 (see FIG. 5). In other words, the height of the blade 52 (54) is greater than the value derived by "{(diameter of porous roller 16)−(diameter of internal rotating body 20)}/2", and the blades function as sealing members which seal the space between the porous roller 16 and the internal rotating body in the regions where the opening sections 40 are provided.

In order to ensure reliable contact between the blade 52 (54) and the interior of the porous roller 16 while preventing the blade 52 (54) from impeding the rotation of the porous roller 16 and the internal rotating body 20, the blade 52 is composed by an elastically deformable member, and the height of the blade 52 (54) should be set to a value equal to or greater than 1.02 times and equal to or lower than 1.2 times the value derived by "{(internal diameter of porous roller 16)−(outer diameter of internal rotating body 20)}/2.

By providing blades 52 and 54 on either side of the opening sections 40 on the outer circumferential surface of the internal rotating body and causing the porous roller 16 and the internal rotating body 20 (blades 52 and 54) to rotate relatively with respect to each other in a state where the blades 52 and 54 make contact with the inner side of the porous roller 16, then liquid in a foamed state is swept away from the inner side of the porous roller 16 and furthermore, by sealing the space between the opening sections 40 and the interior of the porous roller 16, it is possible to concentrate the pressure generated by the pump yet further at the positions of the opening sections 40 and hence the liquid can be recovered with good efficiency.

FIG. 4 shows a mode where the blade 52 and the blade 54 are provided respectively on either side of the opening sections 40, but from the viewpoint of wiping the inner side of the porous roller 16, it is sufficient to provide a blade 52 (54) on at least one side of the opening sections 40.

For the blade 52 (54), it is suitable to use an elastic member made of a rubber material such as fluorine rubber, neoprene rubber, chloroprene rubber, urethane rubber, silicone rubber, or the like, or a resin material such as polyethylene, polypropylene, fluorine resin, or the like. Furthermore, a material having prescribed durability with respect to the liquid absorbed by the porous roller 16 is also desirable.

On the other hand, it is also possible to adopt a mode in which a blade 52 (54) is not provided. The blade 52 (54) makes constant contact with the porous roller 16 and therefore with prolonged use, it suffers wear and problems arise, such as decline in the absorption capability, blocking of the pores by pieces of worn blade, the costs associated with replacement of the blade, decline in throughput, and so on.

If conditions are satisfied whereby the space between the porous roller 16 and the internal rotating body 20 is sufficiently small (if there is a small difference between the internal diameter of the porous roller and the external diameter of the internal rotating body), and the volume of the air and liquid which flows in from this space is sufficiently small in comparison with the volume of air and liquid which flows in by passing through the regions opposing the opening sections 40 inside the porous roller 16 (if the flow resistance of the space between the porous roller 16 and the internal rotating body 20 is sufficiently small compared to the flow channel resistance inside the porous roller 16), then it is possible to concentrate the pressure at the opening sections 40 with respect to the porous roller 16, and therefore a mode which omits the blade 52 (54) is also possible. As one example of the conditions described above, the flow channel resistance of the interior of the porous roller 16 is equal to or less than 1/10 of the flow channel resistance in the space described above.

Figure 5:
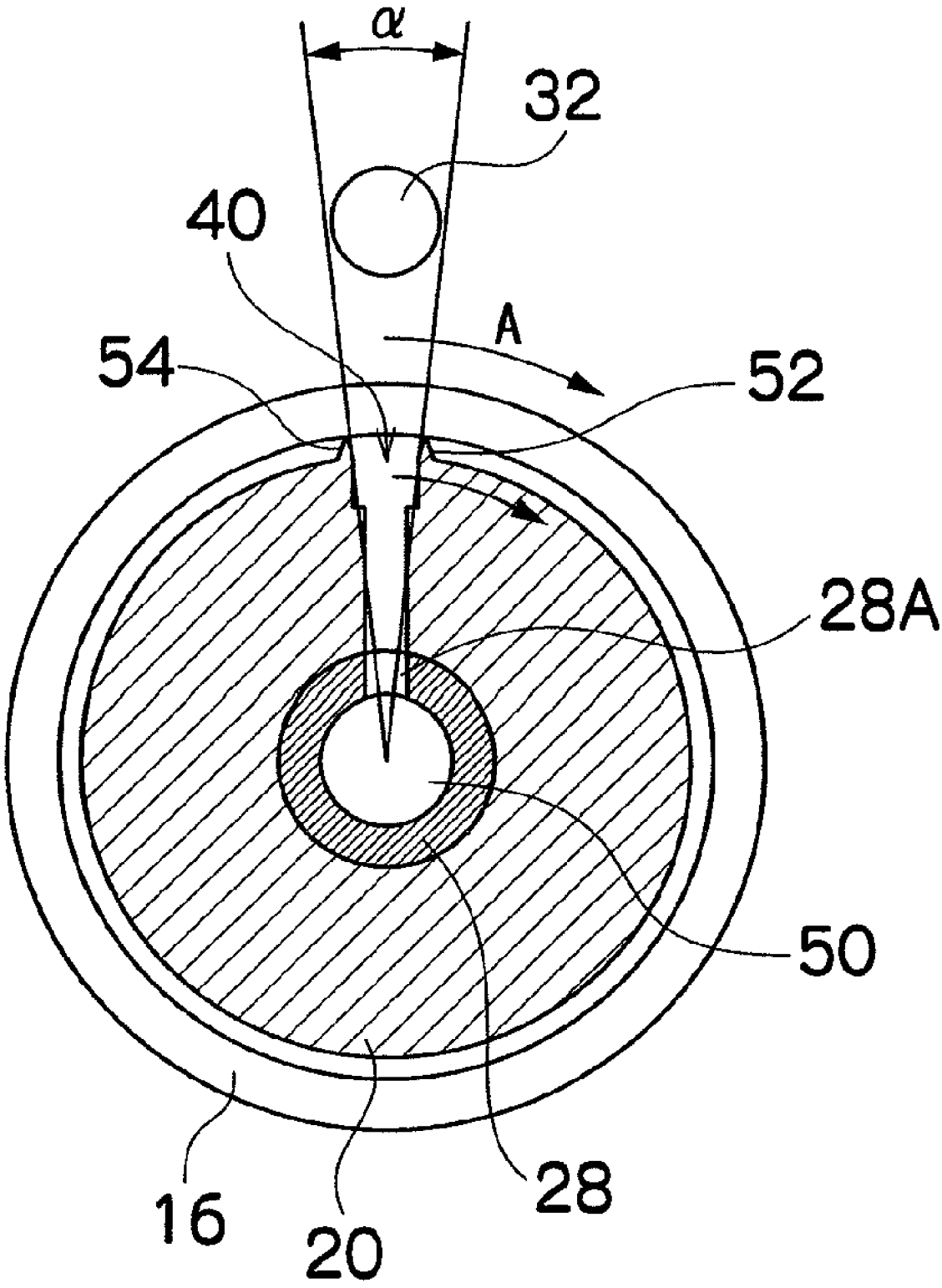
FIG. 5 is a lateral cross-sectional diagram of the liquid absorbing roller illustrated in FIG. 1 (a cross-sectional diagram along line V-V in FIG. 1)
Figure 6:
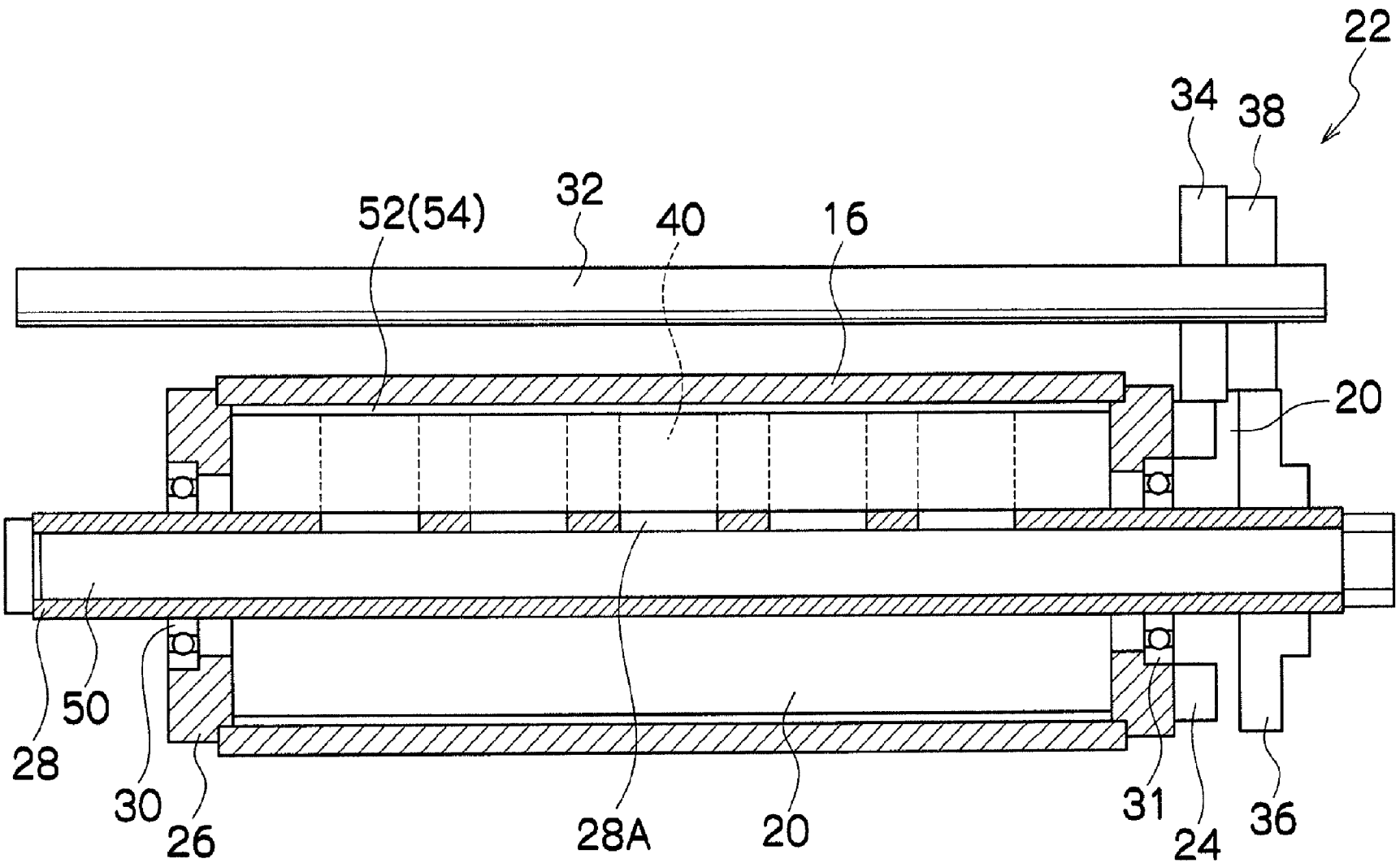
FIG. 6 is a longitudinal cross-sectional diagram of the liquid absorbing roller illustrated in FIG. 1 (a cross-sectional diagram along line VI-VI in FIG. 1)

FIG. 5 shows a lateral cross-sectional diagram of the liquid absorbing roller 22 illustrated in FIG. 1 (a cross-sectional diagram along line V-V in FIG. 1), and FIG. 6 shows a longitudinal cross-sectional diagram of the liquid absorbing roller 22 (a cross-sectional diagram along line VI-VI in FIG. 1).

As illustrated in FIG. 5, the opening sections 40 provided in the internal rotating body 20 have a length which reaches from the outer circumferential surface to a central portion where the shaft 28 is provided (namely, a length of "(radius of internal rotating body 20)−(radius of shaft 28)"), and furthermore the planar form of the opening sections 40 when viewed in lateral cross-section is substantially a fan shape, as illustrated in FIG. 5. Moreover, the opening sections 40 have a structure in which the end portion thereof on the opposite side from the outer circumferential surface is connected to the reduced pressure space 50 via a reduced pressure port 28A in the shaft 28. Furthermore, the opening sections 40 also have a structure in which the width thereof in the region which is not in the vicinity of the outer circumferential surface (a region having a length of substantially 2/3 of the radius of the internal rotating body 20 toward the outside from the shaft 28) is narrower than the width in the vicinity of the outer circumferential surface (a region having a length of substantially 1/3 of the radius of the internal rotating body 20 to the inner side from the outer circumferential surface).

Moreover, FIG. 5 shows a mode where $\alpha=30°$ is taken as an example of the opening angle $\alpha$ of the opening sections 40. Desirably, the opening angle of the opening sections 40 is set to be equal to or greater than 5° and equal to or less than 90°, and more desirably, the opening angle $\alpha$ is set to be equal to or greater than 15° and equal to or less than 45°.

FIG. 6 shows a mode where the plurality of opening sections 40 have the same length in the lengthwise direction and the plurality of opening sections 40 are aligned at equidistant intervals. The shaft 28 which is provided on the central axis of the internal rotating body 20 has a hollow structure, and the hollow structure functions as the reduced pressure space 50 as described in relation to FIG. 4. More specifically, a pump (not illustrated) is connected to one end portion of the shaft 28.

From the viewpoint of achieving good resistance to liquids, reducing weight and lowering costs, it is suitable to use a resin material, such as polyacetal, acryl or fluorine resin, or a metal material, such as an aluminum alloy, for the internal rotating body 20. Moreover, it is suitable to use a metal material such as stainless steel (SUS) for the shaft 28.

In the liquid removal apparatus 10 according to the present embodiment, since a composition for recovering liquid which has been absorbed by the porous roller 16 is built into the liquid absorbing roller 22, and the liquid is recovered before the porous roller 16 becomes filled with liquid and becomes unable to absorb further liquid, then it is possible to remove the liquid continuously over a long period of time.

Next, the conditions for maintaining liquid removal processing in a continuous fashion will be described. In order to achieve continuous liquid removal processing, it is necessary that the liquid which has been absorbed by the porous roller 16 be recovered before the amount of liquid absorbed by the porous roller 16 exceeds the permitted absorption volume, and if $T_1$ is taken to be the time period (the possible absorption time) from a state where the porous roller 16 has not absorbed liquid (a state where the liquid absorption volume in the porous roller 16 is zero) until a state where the porous roller 16 has absorbed liquid equivalent to the permitted absorption volume, then provided that the internal rotating body 20 (opening sections 40) rotates once with respect to the porous roller 16 in the time period from the start of liquid removal using the porous roller 16 which has not absorbed any liquid until the possible absorption time $T_1$ has elapsed, the opening sections 40 will have scanned over the whole of the inner surface of the porous roller 16 and therefore it can be considered that all of the liquid which has been absorbed by the porous roller 16 will have been duly recovered.

The time period required for the internal rotating body 20 to rotate once with respect to the porous roller 16 can be expressed by "$1/|N_1-N_2|$", in terms of the number of rotations $N_1$ per unit time (rpm) of the porous roller 16 and the number of rotations $N_2$ per unit time (rpm) of the internal rotating body 20. In other words, the conditions for performing continuous liquid removal processing are expressed by Formula (1).

$$1/|N_1-N_2|<T_1 \quad (1)$$

The possible absorption time $T_1$ varies with the material and thickness (total volume) of the porous roller 16 and the properties of the liquid which is absorbed, and therefore it was measured as described below.

Firstly, an experimental liquid was manufactured by the method described below, and this experimental liquid was applied continuously onto an image forming body (made of polyimide; thickness: 80 μm) by a bar coater. The application volume of the experimental liquid was set to 14 (ml/m$^3$).

Method of Manufacturing Experimental Liquid

Diethylene glycol: 20.0 wt % (weight percent)

Olefin E1010: 1.0 wt %

Ion-exchanged water: 79.0 wt %

The experimental liquid on the image forming medium was absorbed by the porous roller 16 (made of silicon carbide, average pore diameter 40 μm, outer diameter 70 mm, inner diameter 60 mm (thickness 5 mm), void ratio 50%) while the porous roller 16 rotates idly at a conveyance speed of 500 mm/sec of the image forming medium 12 (see FIG. 1), and it was confirmed visually whether or not there was experimental liquid remaining on the surface of the image forming medium after this liquid removal processing (after the image forming medium had passed directly below the porous roller 16). Continuous liquid removal was carried out using the porous roller 16 having a zero volume of absorbed liquid, and the time until the presence of liquid was confirmed on the image forming medium after liquid removal processing was taken as the measurement value for the possible absorption time $T_1$. The measurement value for the possible absorption time $T_1$ according to the present experiment was 0.64 (min).

Moreover, since the porous roller 16 rotates idly with respect to the image forming medium 12, then the conveyance speed of the image forming medium 12 is the same as the linear speed of the porous roller 16, and therefore the number of rotations $N_1$ per unit time of the porous roller in the present experiment was $N_1$=136 (rpm). Under the conditions of the present experiment, if the difference $|N_1-N_2|$ between the number of rotations $N_1$ per unit time of the porous roller and the number of rotations $N_2$ per unit time of the internal rotating body 20 satisfies the relationship $|N_1-N_2|>1.56$ (rpm), then it is considered that liquid removal processing can be carried out continuously.

If the conditions which permit liquid removal processing to be carried out continuously are considered from a different perspective, provided that the liquid present on the outer circumferential surface of the porous roller 16 can be moved to the inner circumferential surface opposing the internal rotating body 20 within the time period required for the opening sections 40 of the internal rotating body 20 to travel relatively past one point on the porous roller 16 (the time period required for the internal rotating body 20 to rotate through the angle α of the opening of the opening sections 40), then it is possible to recover all of the liquid which has been absorbed by the porous roller 16 via the opening sections 40 in the thickness direction of the porous roller 16.

In other words, if the time period required for the internal rotating body 20 to rotate through the opening angle α of the opening sections 40 (absorption time) is taken to be $T_2$ and the time period required for the liquid present on the outer circumferential surface of the porous roller 16 to move to the inner circumferential surface (movement time) is taken to be $T_3$, then it is considered that liquid removal processing can be carried out continuously provided that the relationship of Formula (2) is satisfied.

$$T_2>T_3 \quad (2)$$

The rotation time $T_2$ is expressed by Formula (3).

$$T_2=(1/|N_1-N_2|)\times(\alpha/360) \quad (3)$$

On the other hand, the movement time $T_3$ depends on the absorptive characteristics of the porous roller 16 (the material, void ratio, average pore size), and the physical properties of the liquid used, and therefore the actual value was found by measurement in the following manner.

Acrylic (transparent material) was used for the flange member 26 (24) which supports one end portion of the porous roller 16, thus making it possible to observe the state of the porous roller 16 during pressure reduction of the interior space, and the pressure of the interior of the porous roller 16 was reduced by means of a pump, the experimental liquid described above was deposited continuously onto the outer circumferential surface of the porous roller 16, and the time period required until the experimental liquid was expelled from the inner circumferential surface of the porous roller was measured and set as the movement time $T_3$. The measured value of the movement time $T_3$ was $T_3$=0.013 (min). In other words, by satisfying $T_2>0.013$ (min), it is possible to carry out continuous liquid removal processing.

In a case where the opening angle α of the opening sections 40 is 30° as illustrated in FIG. 5, the conditions are expressed by Formula (4).

$$(1/|N_1-N_2|)\times(1/12)>0.013 \text{ (min)} \quad (4)$$

Consequently, the desirable differential $|N_1-N_2|$ between the number of rotations $N_1$ per unit time of the porous roller and the number of rotations $N_2$ per unit time of the internal rotating body 20 is as shown in Formula (5).

$$|N_1-N_2|<6.41 \text{ (rpm)} \quad (5)$$

To summarize the foregoing, under the experimental conditions described above, the relationship between the number of rotations $N_1$ per unit time of the porous roller and the number of rotations $N_2$ per unit time of the internal rotating body 20 which is suited to the liquid removal apparatus 10 described in the present embodiment is as shown in Formula (6), and the desirable range of the number of rotations $N_2$ per unit time of the internal rotating body 20 when the number of rotations $N_1$ per unit time of the porous roller is $N_1$=136 (rpm) is expressed by Formula (7) when $N_1>N_2$ is satisfied, and is expressed by Formula (8) when $N_1<N_2$ is satisfied.

$$1.56 \text{ (rpm)}<|N_1-N_2|<6.41 \text{ (rpm)} \quad (6)$$

$$129.59 \text{ (rpm)}<N_2<134.44 \text{ (rpm)} \quad (7)$$

$$137.56 \text{ (rpm)}<N_2<142.41 \text{ (rpm)} \quad (8)$$

In this way, in the liquid removal apparatus 10 according to the present embodiment, the relative speed between the porous roller 16 and the internal rotating body 20 is approximately several rpm, and therefore it is possible to achieve a sufficient time for absorbing the porous roller 16, compared to a case where either one of the porous roller 16 or the internal rotating body 20 is fixed.

The liquid removal apparatus 10 having the composition described above comprises an internal rotating body 20 provided inside the hollow space of a hollow-centered round cylindrical porous roller 16, the internal rotating body 20 having a round cylindrical shape which corresponds to the hollow shape of the porous roller 16; and opening sections 40 corresponding to the length of the porous roller 16 in the direction of the axis of rotation of the porous roller 16 are provided in the outer circumferential surface 20A of the internal rotating body 20, the interior of the porous roller 16 being reduced to low pressure via the opening sections 40 while rotating the porous roller 16 and the interior structure separately and maintaining a prescribed relative speed differential. Therefore, it is possible to recover the liquid absorbed by the porous roller 16 in an efficient manner.

Furthermore, since the number of rotations $N_1$ per unit time of the porous roller 16 and the number of rotations $N_2$ per unit time of the internal rotating body 20 are optimized, then it is possible to recover the liquid absorbed by the porous roller 16 efficiently, and furthermore all of the liquid absorbed by the porous roller 16 is recovered before the amount of liquid absorbed by the porous roller 16 exceeds the permitted absorption volume, and liquid removal processing by the porous roller 16 can therefore be carried out continuously over a long period of time, in a more reliable fashion.

A desirable relationship between the number of rotations $N_1$ per unit time of the porous roller 16 and the number of rotations $N_2$ per unit time of the internal rotating body 20 is expressed by Formula (1) above, and taking $T_2$ to be the time period required for the internal rotating body 20 to rotate through the opening angle $\alpha$ of the opening sections 40 and taking $T_3$ to be the time period required for the liquid present on the outer circumferential surface of the porous roller 16 to move to the inner circumferential surface, then the relationship is expressed by Formula (2) above.

Incidentally, in Formula (1), $T_1$ is the time from a state where the porous roller 16 has not absorbed any liquid until a state where the porous roller 16 has absorbed the permitted absorption volume of liquid, and $T_2$ is expressed by Formula (3) when $\alpha$ is taken as the opening angle of the opening sections 40 in Formula (2).

In the present example, a mode is described in which a porous member is used as a device for absorbing and removing liquid on the image forming medium, but it is also possible to use a wide range of materials which are capable of absorbing liquid, instead of or in conjunction with a porous member. Furthermore, the present example is described with respect to a mode which involves absorbing liquid on a medium where an image is formed, but the apparatus of the present embodiment may be adapted broadly to apparatuses which remove liquid from the surface of a base material (a metal substrate, a resin substrate, a glass substrate, or the like).

APPLICATION EXAMPLE

Figure 7:
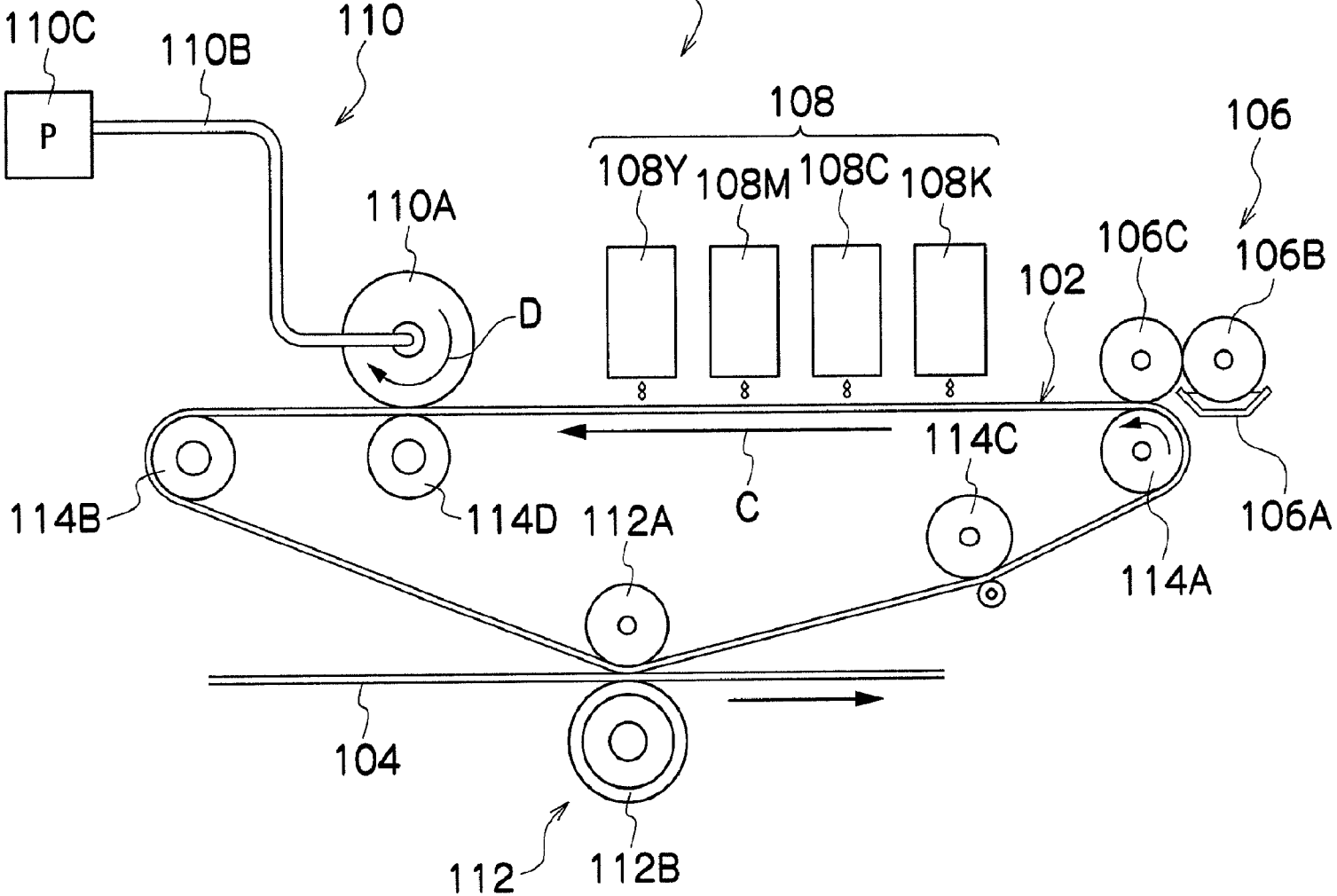
FIG. 7 is a general schematic drawing of an inkjet recording apparatus relating to an application example of the present invention.

Next, an application example of the liquid removal apparatus 10 relating to an embodiment of the present invention will be described. FIG. 7 shows an example of an apparatus in which the liquid removal apparatus is applied to an inkjet recording apparatus.

The inkjet recording apparatus 100 illustrated in FIG. 7 uses a transfer recording method in which a primary image is formed on an intermediate transfer body 102 and the primary image on the intermediate transfer body 102 is then transferred and recorded onto a recording medium 104. Furthermore, a two-liquid method is used in which when forming the primary image on the intermediate transfer body 102, the ink which contains pigment particles (coloring material particles) is reacted with a treatment liquid on the intermediate transfer body 102, thereby causing the coloring material particles to aggregate.

In other words, the inkjet recording apparatus 100 comprises: a treatment liquid application unit 106 which applies a treatment liquid having a function of aggregating or insolubilizing ink over the whole surface of the image forming region where the primary image is formed on the intermediate transfer body 102; a print unit 108 having a plurality of inkjet heads (heads) 108K, 108C, 108M, 108Y provided corresponding to inks containing coloring materials of respective colors of black (K), cyan (C), magenta (M) and yellow (Y); a liquid removal processing unit 110 which removes the solvent (liquid component) after the treatment liquid and ink have reacted on the intermediate transfer body 102 and the ink coloring material (dots) and solvent have respectively separated; and a transfer recording unit 112 which transfers and records the primary image formed on the intermediate transfer body 102 onto the recording medium 104.

Furthermore, although not illustrated in FIG. 7, the inkjet recording apparatus 100 comprises: an ink storing and loading unit which stores inks to be supplied to the respective heads 108K, 108C, 108M and 108Y of the print unit 108; a preheating unit which previously heats the primary image before transfer and recording; a paper supply unit which accommodates the recording medium 104 and supplies the recording medium 104 to the transfer recording unit 112; a separating unit which separates the intermediate transfer body 102 and the recording medium 104 after the transfer recording operation of the transfer recording unit 112; a fixing unit which fixes the image that has been transferred and recorded onto the recording medium 104 after the separation from the intermediate transfer body 102; an output unit which outputs the recording medium that has been subjected to the fixing process by the fixing unit, to the exterior of the apparatus; and a cleaning processing unit which cleans the image forming region of the intermediate transfer body 102 and removes adhering material, such as ink or the like, which is remaining on the image forming region, after the transfer recording operation.

The intermediate transfer body 102 is an endless belt which is wound about a plurality of tensioning rollers 114A, 114B and 114C, and a heating roller 112A which also serves as the transfer recording unit 112, and when at least one of the tensioning roller (drive roller) of the tensioning rollers 114A and 114B is rotated, then the intermediate transfer body 102 is moved in a prescribed direction in synchronism with the rotation of the drive roller. For example, when the tensioning roller 114A is taken as a drive roller and caused to rotate in the counter-clockwise direction, then the intermediate transfer body 102 is moved from right to left in FIG. 1 (the direction of movement of the intermediate transfer body, marked by the arrow indicated by C in FIG. 1), in the print region directly below the print unit 108. A roller 114D functions as a supporting member which supports the intermediate transfer body 102 directly below the liquid removal processing unit 110.

In the inkjet recording apparatus 100 described in the present embodiment, the speed of movement of the intermediate transfer body 102 is controlled so as to be uniform through the series of image forming processes. The speed of movement of the intermediate transfer body 102 can be changed appropriately in accordance with the ink droplet ejection cycle of the print unit 108 and the resolution of the recorded image. For example, if the ink droplet ejection cycle is uniform, then when the speed of movement of the intermediate transfer body 102 is relatively faster, the resolution of the recorded image becomes coarser, and when the speed of movement of the intermediate transfer body 102 is relatively slower, the resolution of the recorded image becomes finer.

Furthermore, the intermediate transfer body 102 has non-permeable properties which do not allow permeation of ink droplets in at least the image forming region where the primary image is formed on the image forming surface which opposes the print unit 108, and it is suitable to use a material such as resin, metal or rubber for the intermediate transfer body 102. Furthermore, at least the image forming region of the intermediate transfer body 102 is composed so as to have a horizontal surface (flat surface) which has a prescribed flatness.

FIG. 7 shows an endless belt as one mode of the intermediate transfer body 102, but the intermediate transfer body 102 used in the present invention may also have a drum shape or a flat plat shape. Furthermore, the intermediate transfer body 102 may be formed by a multiple-layer structure which has a supporting body (supporting layer) having a prescribed rigidity, on the inner side of the surface layer.

Desirable materials for use as the surface layer (an image forming layer) of the intermediate transfer body 102 are, for example, commonly known materials such as: a polyimide resin, a silicone resin, a polyurethane resin, a polyester resin, a polystyrene resin, a polyolefin resin, a polybutadiene resin, a polyamide resin, a polyvinyl chloride resin, a polyethylene resin, a fluorine resin, and the like.

The treatment liquid application unit 106 comprises: an accommodating section 106A in which the treatment liquid is accommodated; a take-up roller 106B which takes up the treatment liquid from the accommodating section 106A; an application roller 106C which absorbs into the surface thereof the treatment liquid which has been taken up from the accommodating section 106A by the take-up roller 106B and which applies the treatment liquid to the intermediate transfer body 102 by means of the surface thereof making contact with the intermediate transfer body 102; and an elevator mechanism (not illustrated) which moves the application roller 106C in the upward and downward direction. A material having a function of absorbing liquid, such as a porous member, is used for the surface of the application roller 106C, and a composition is adopted in which the distance between the roller and the intermediate transfer body 102 can be altered by means of the elevator mechanism.

When the treatment liquid is applied to the intermediate transfer body 102, the position of the application roller 106C is moved in such a manner that the application roller 106C makes contact with the intermediate transfer body 102 and furthermore, is pressed against same with a prescribed pressure. On the other hand, if the treatment liquid is not to be applied to the intermediate transfer body 102, then the position of the application roller 106C is moved in such a manner that the application roller 106C is separated from the intermediate transfer body 102.

Figure 8:
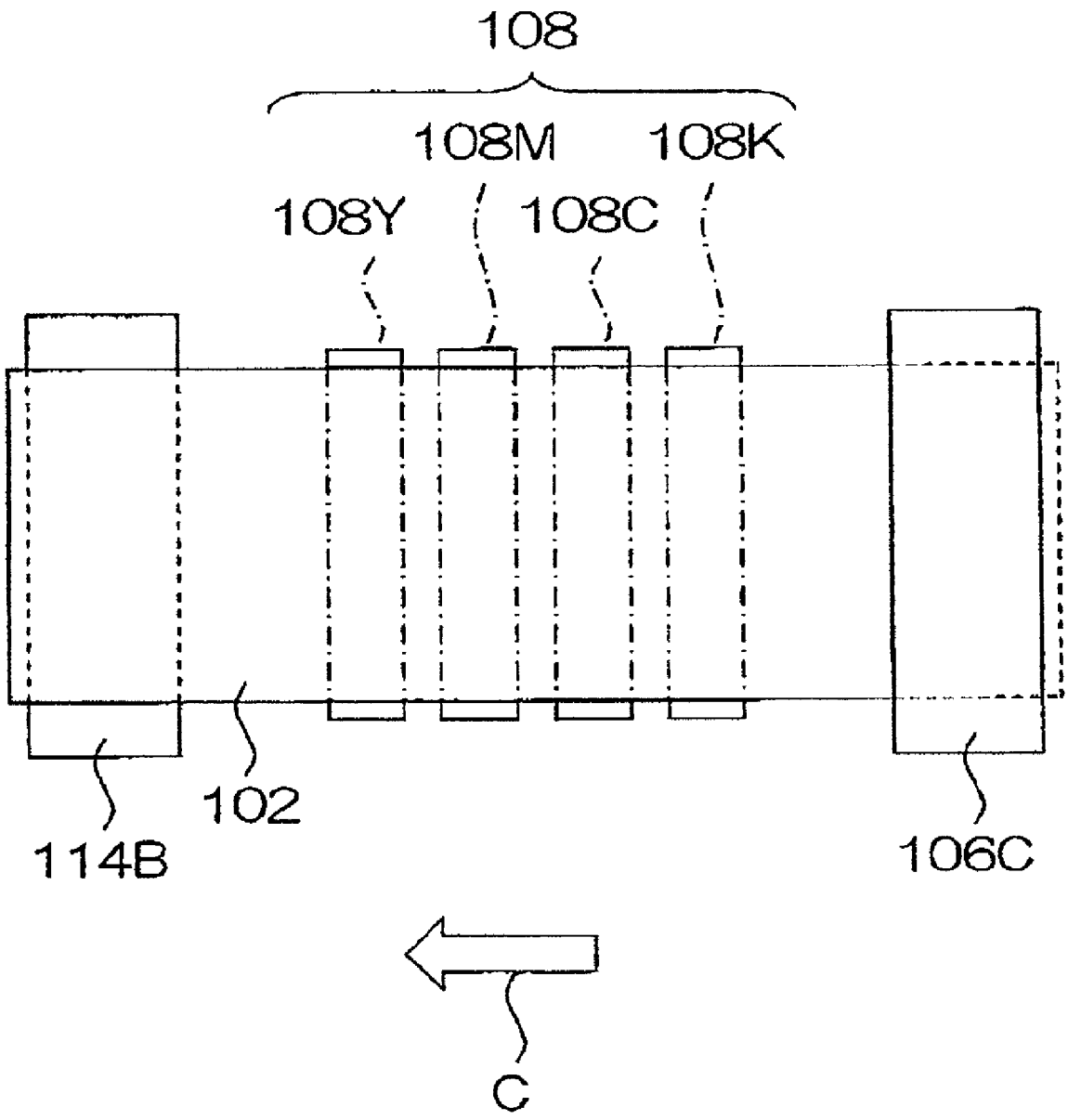
FIG. 8 is a principal plan diagram of the peripheral area of a print unit in the inkjet recording apparatus illustrated in FIG. 7.

The application roller 106C has a round cylindrical shape, and the length thereof in the lengthwise direction corresponds to the width of the intermediate transfer body 102 (the length in the direction perpendicular to the direction of movement of the intermediate transfer body) (see FIG. 8). It is also possible to adopt a composition in which a plurality of application rollers having a shorter length than the width of the intermediate transfer body 102 are arranged in the breadthways direction of the intermediate transfer body 102.

In the present embodiment, a mode is described in which a treatment liquid is applied to the intermediate transfer body 102 by means of an application roller 106C, but it is also possible to use another application member, such as a blade, instead of the application roller 106C, and it is also possible to deposit the treatment liquid on the intermediate transfer body 102 by means of a spraying method or an inkjet method.

The print unit 108 is provided on the downstream side of the treatment liquid application unit 106 in terms of the direction of movement of the intermediate transfer body. The details of the print unit 108 are described below. The ink storing and loading unit which supplies inks to the respective heads 108K, 108C, 108M and 108Y of the print unit 108 has ink supply tanks (indicated by reference numeral 160 in FIG. 11) which store inks of colors corresponding to the respective heads, and the inks of the respective colors are connected to the heads via prescribed ink flow channels. The ink storing and loading unit also comprises a warning device (for example, a display device or an alarm sound generator) for warning when the remaining amount of any ink is low, and uses a member having a mechanism for preventing loading errors between different colors.

A treatment liquid removal processing unit 110 is provided to the downstream side of the print unit 108 in terms of the direction of movement of the intermediate transfer body. Since the liquid removal apparatus 10 which has been described above is employed for the liquid removal processing unit 110, a detailed description thereof is omitted here.

In other words, the liquid removal processing unit 110 comprises a liquid absorbing roller 110A which makes contact with the liquid on the intermediate transfer body 102 and absorbs this liquid, and a pump 110C which is connected to the liquid absorbing roller 110A via a pipe 110B and which reduces the pressure of the interior of the liquid absorbing roller 110A. Furthermore, a supporting roller 114D which supports the intermediate transfer body 102 and is pressed against the liquid absorbing roller 110A, is provided on the opposite side of the liquid absorbing roller 110A with respect to the intermediate transfer body 102.

The liquid removal processing unit 110 removes the liquid component on the intermediate transfer body 102 by means of the liquid absorbing roller 110A making contact with the intermediate transfer body 102 while rotating at a uniform speed in the direction of rotation indicated by the reference D in FIG. 7. Furthermore, the liquid removal processing unit 110 operates the pump 110C in such a manner that the liquid removed by the liquid absorbing roller 110A is recovered during the liquid removal process (during the rotation of the liquid absorbing roller 110A).

The preheating unit is provided to the downstream side of the liquid removal processing unit 110 in terms of the direction of movement of the intermediate transfer body. A flat plate-shaped infrared heater is suitable for use as the preheating unit, and a preheating temperature which is approximately 10° C. to 20° C. lower than the heating temperature during the transfer recording step is applied to the primary image (intermediate transfer body). In the present embodiment, the preheating temperature is set to the range of 50° C. to 100° C. A mode is also possible in which a heater is provided inside the image forming region of the intermediate transfer body 102 and the intermediate transfer body is preheated by means of this heater.

The preheating process which is carried out by the preheating treatment unit makes it possible to shorten the heating time during the transfer recording step, by previously raising the temperature of the primary image or the vicinity thereof to a temperature which is slightly lower than the temperature suitable for transfer recording.

The primary image which has been subjected to preheating treatment is transferred and recorded onto the recording medium 104 by the transfer recording unit 112. In the transfer recording step performed by the transfer recording unit 112, firstly, the recording medium 104 is supplied from a paper supply unit (not illustrated) via a prescribed supply channel, and the recording medium 104 and the intermediate transfer body 102 (primary image) are registered mutually in position. Next, the recording medium 104 is sandwiched in between the pressurization roller 112B and the intermediate transfer body 102, and by pressurizing at a prescribed pressure by means of the pressurization roller 112B while heating to a prescribed temperature by means of a heater built into the heating roller 112A, the primary image formed on the intermediate transfer body 102 is transferred and recorded to the recording medium 104.

Possible examples of the composition of the paper supply unit include a cassette in which cut paper is loaded in a stacked fashion, or a magazine for rolled paper (continuous paper). It is also possible to use a plurality of cassettes conjointly to correspond to recording media having different widths, qualities, and so on. Moreover, paper may also be supplied in cassettes which contain cut paper loaded in a stacked state, in lieu of or in combination with magazines for rolled paper (continuous paper).

In the case of a configuration in which a plurality of types of recording paper can be used, it is preferable that an information recording medium such as a bar code and a wireless tag containing information about the type of paper is attached to the cassette, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

In the case of the configuration in which roll paper is used, a cutter is provided, and the continuous paper is cut into a desired size by the cutter The cutter has a stationary blade whose length is not less than the width of the conveyor pathway of the recording medium, and a round blade which moves along the stationary blade. The stationary blade is disposed on the reverse side of the printed surface of the recording medium, and the round blade is disposed on the printed surface side across the conveyor pathway.

Furthermore, concrete examples of the recording medium 104 used in the present embodiment are: normal paper, permeable media, such as special inkjet paper, non-permeable media or low-permeability media, such as coated paper, sealed paper having adhesive or a detachable label on the rear surface thereof, a resin film, such as an OHP sheet, or a metal sheet cloth, wood are other types of media.

The transfer temperature during the transfer recording step is set in the range of 60° C. to 120° C., and the transfer pressure is set in the range of 0.5 MPa to 3.0 MPa. The transfer temperature and the transfer pressure may be adjusted appropriately in accordance with the type of recording medium (material, thickness, etc.), or the type of ink used. For example, if the thickness of the recording medium 104 is relatively thick, then the transfer pressure is made relatively lower, and if the thickness of the recording medium 104 is relatively thin, then the transfer pressure is made relatively higher. Furthermore, if the surface of the recording medium 104 is relatively rough (for example, if normal paper is used), then the transfer pressure is set to a relatively high pressure, and if the surface of the recording medium 104 is relatively smooth (for example, if using photographic paper or coated paper), then the transfer pressure is set to a relatively low pressure.

As a device for adjusting the transfer pressure during transfer and recording in the transfer and recording unit 112, it is possible to employ a mechanism (drive device) which moves the pressurization roller 112B in the vertical direction in FIG. 7. In other words, if the heating roller 112A (or the pressurization roller 112B) is moved in a direction which increases the clearance between the heating roller 112A and the pressurization roller 112B, then the transfer pressure becomes lower, and if the heating roller 112A (or the pressurization roller 112B) is moved in a direction which reduces the clearance between the heating roller 112A and the pressurization roller 112B, then the transfer pressure becomes greater.

When the transfer recording onto the recording medium 104 has been completed in the transfer recording unit 112, the recording medium 104 bearing the recorded image is separated from the intermediate transfer body 102 in a separation unit (not illustrated), and the recording medium 104 is supplied to the fixing unit.

The separation unit is composed in such a manner that the recording medium 104 becomes detached from the intermediate transfer body 102 due to the rigidity (material strength) of the recording medium 104 and the bending curvature of the intermediate transfer body 102 with respect to the separating roller. A device for promoting detachment, such as a separating hook, may also be used in the separation unit. A desirable mode is one where a cooling apparatus for cooling the recording medium 104 is provided between the separation unit and the fixing unit.

Possible examples of the cooling apparatus are a composition where a fan is provided for blowing a cooling air onto the recording medium 104, and a composition where a cooling member, such as a Peltier element or heat sink, is provided.

In the fixing unit, a fixing treatment step is carried out and the image which has been recorded onto the recording medium 104 is fixed by applying heat and pressure. The fixing unit is, for example, constituted by a heating roller pair in which the temperature can be adjusted in the range of 50° C. to 200° C. A desirable mode is one where the heating temperature of the fixing unit is 130° C., and the pressure is 0.5 MPa to 3.0 MPa. The heating temperature of the fixing unit should be set in accordance with the glass transition temperature of the polymer micro-particles contained in the ink, or the like.

If the ink contains resin micro-particles or polymer micro-particles, then it is possible to improve the fixing properties/rubbing resistance by forming a film of polymer micro-particles (namely, forming a thin film of dissolved micro-particles on the outermost surface layer of the image). Since both transfer properties and film manufacturing characteristics can be achieved in the transfer step in the transfer unit 112, then it is also possible to adopt a mode in which the fixing unit is omitted.

When the fixing treatment step has been completed, the recording medium 104 bearing the recorded image is output to the exterior of the apparatus. Although not shown in the drawings, a desirable mode is one where a collection tray is provided for accommodating the recording media 104 output to the exterior of the apparatus.

When the transfer recording step onto the recording medium 104 has been completed, the intermediate transfer body 102 is subjected to a cleaning process carried out by a cleaning processing unit which is provided to the downstream side of the transfer recording unit 112 in terms of the direction of movement of the intermediate transfer body. The cleaning processing unit comprises a blade which wipes and removes the adhering material, such as residual ink, while abutting against the image forming surface of the intermediate transfer body 102, and a recovery unit which recovers the residual ink or the like that has been removed. The composition of the cleaning processing unit which removes the residual material from the intermediate transfer body 102 is not limited to the example given above, and it is also possible to adopt a system based on nipping a brush roller or water-absorbing roller, or the like, an air blower system which blows clean air, an adhesive roller system, or a combination of these systems. In the case of the configuration of nipping with the cleaning roller, it is preferable to make the linear velocity of the cleaning roller different from that of the belt, in order to improve the cleaning effect.

Description of Print Unit

Next, the print unit 108 will be described. As illustrated in FIG. 8, the heads 108K, 108C, 108M and 108Y of the print unit 108 are each full-line heads having a length corresponding to the maximum width of the image forming region of the intermediate transfer body 102, and having a plurality of nozzles for ejecting ink (not illustrated in FIG. 7 and indicated by reference numeral 51 in FIGS. 9A to 9C) arranged through the full width of the image forming region.

The print heads 108K, 108C, 108M and 108Y are arranged in color order (black (K), cyan (C), magenta (M), yellow (Y)) from the upstream side in the move direction of the intermediate transfer body 102, and these respective heads 108K, 108C, 108M and 108Y are fixed extending in a direction perpendicular to the move direction of the intermediate transfer body 102.

By adopting a configuration in which full line heads having nozzle rows covering the full width of the intermediate transfer body 102 are provided for each color of ink, it is possible to record a primary image on the image forming region of the intermediate transfer body 102 by performing just one operation of moving the intermediate transfer body 102 and the print unit 108, relatively, in the direction of movement of the intermediate transfer body 102 (the sub-scanning direction, see FIGS. 9A to 9C), (in other words, by means of one sub-scanning action). Accordingly, it is possible to achieve higher speed printing compared to a serial (shuttle) type of head in which the heads 108K, 108C, 108M and 108Y are moved back and forth reciprocally in the main scanning direction (see FIGS. 9A to 9C) which is perpendicular to the direction of movement of the intermediate transfer body 102, and therefore the print productivity can be improved.

Although the configuration with the KCMY four standard colors is described in the present embodiment, combinations of the ink colors and the number of colors are not limited to those. Light inks, dark inks or special color inks can be added as required. For example, a configuration is possible in which ink heads for ejecting light-colored inks such as light cyan and light magenta are added. Furthermore, there are no particular restrictions of the sequence in which the heads of respective colors are arranged.

Structure of the Head

Next, the structure of heads 108K, 108C, 108M and 108Y will be described. The heads 108K, 108C, 108M and 108Y of the respective ink colors have the same structure, and a reference numeral 150 is hereinafter designated to any of the heads.

Figure 9A:
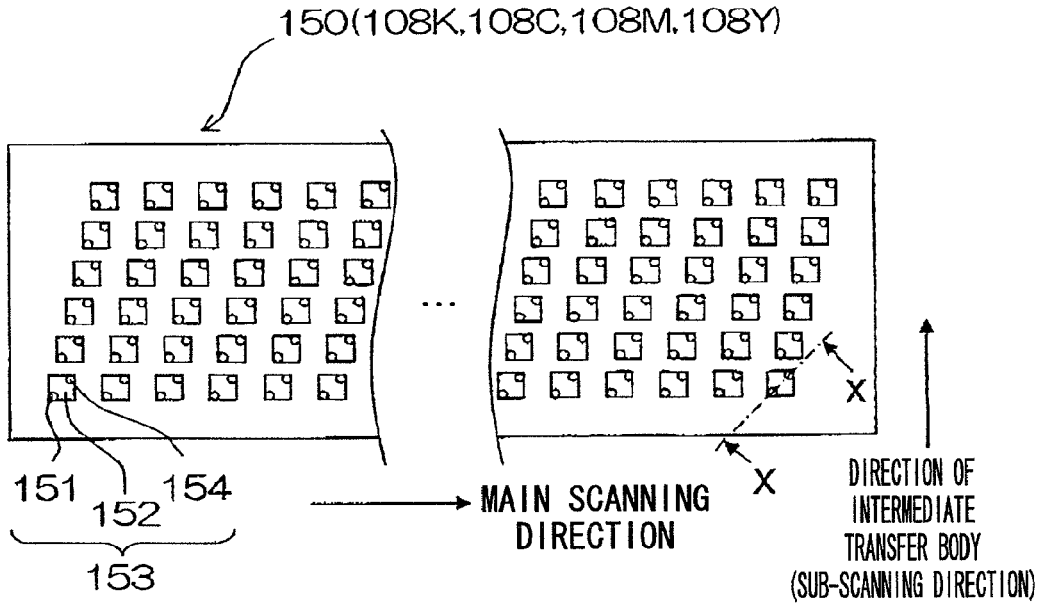
FIGS. 9A to 9C are plan view perspective diagrams showing examples of the composition of the head illustrated in FIG. 7.
Figure 9B:
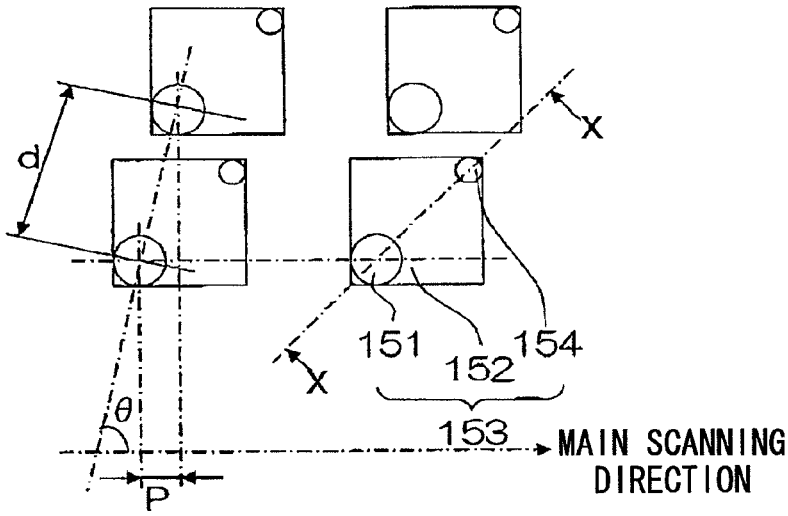
Figure 9C:
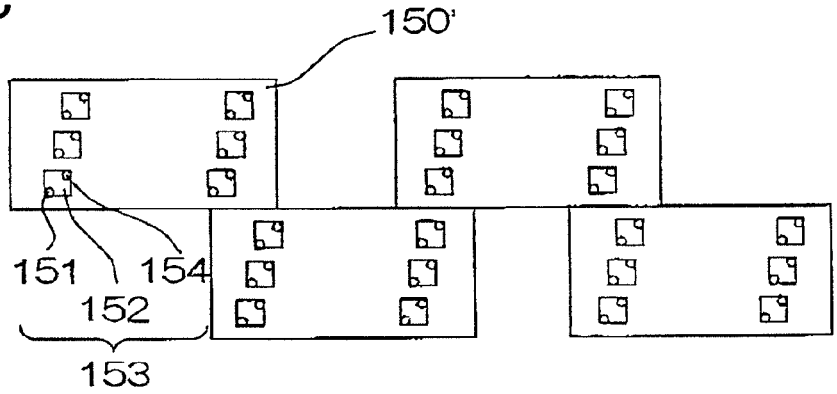
Figure 10:
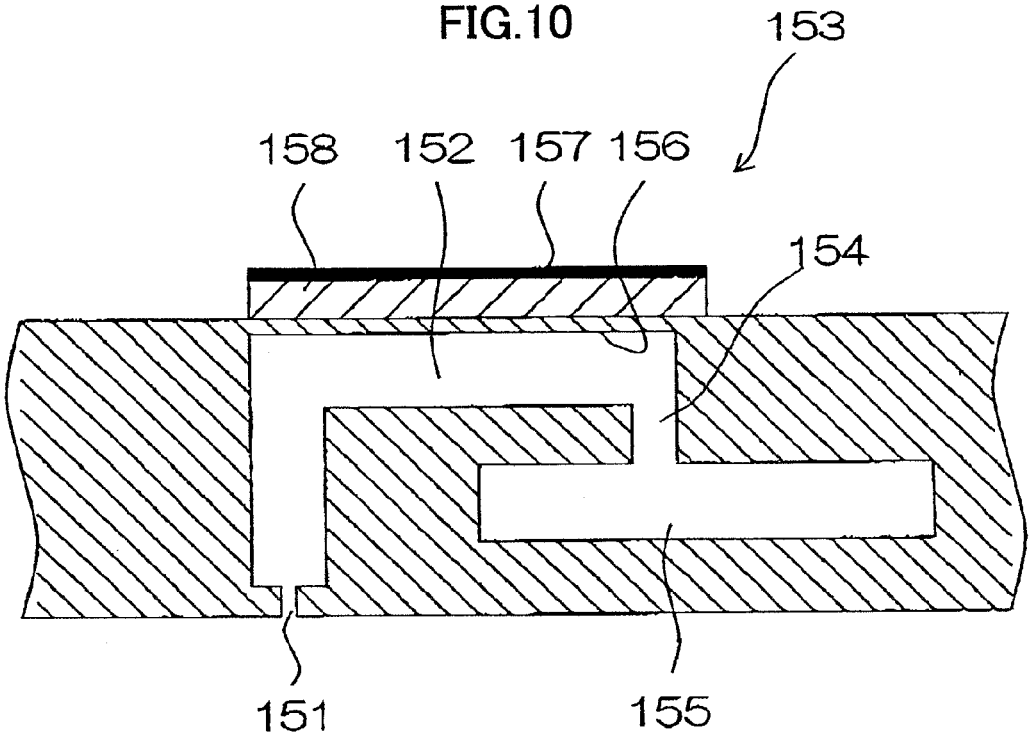
FIG. 10 is a cross-sectional diagram along line X-X in FIGS. 9A to 9C.

FIG. 9A is a perspective plan view showing an example of the configuration of the head 150, FIG. 9B is an enlarged view of a portion thereof, FIG. 9C is a perspective plan view showing another example of the configuration of the head 150, and FIG. 10 is a cross-sectional view (taken along the line X-X in FIGS. 9A and 9B).

The nozzle pitch in the head 150 should be minimized in order to maximize the density of the dots formed on the surface of the intermediate transfer body 102. As illustrated in FIGS. 9A and 9B, the head 150 according to the present embodiment has a structure in which a plurality of ink chamber units 153, each comprising a nozzle 151 forming an ink droplet ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the sub-scanning direction perpendicular to the paper conveyance direction) is reduced and high nozzle density is achieved.

The mode of forming one or more nozzle rows through a length corresponding to the entire width of the intermediate transfer body 102 in a direction substantially perpendicular to the conveyance direction of the intermediate transfer body 102 is not limited to the example described above. For example, instead of the configuration in FIG. 9A, as illustrated in FIG. 9C, a line head having nozzle rows of a length corresponding to the entire width of the intermediate transfer body 102 can be formed by arranging and combining, in a staggered matrix, short head blocks 150' having a plurality of nozzles 151 arrayed in a two-dimensional fashion. Furthermore, although not shown in the drawings, it is also possible to compose a line head by arranging short heads in one row.

The planar shape of the pressure chamber 152 provided for each nozzle 151 is substantially a square, and the nozzle 151 and a supply port 154 are disposed in both corners on a diagonal line of the square. Each pressure chamber 152 is connected to a common channel 155 through the supply port 154. The common channel 155 is connected to an ink supply tank (not illustrated in FIGS. 9A to 9C, but illustrated in FIG. 11 by reference number 60), which serves as an ink supply source, and the ink supplied from this ink supply tank is delivered through the common flow channel 155 in FIGS. 9A to 9C to the pressure chambers 152.

As illustrated in FIG. 10, a piezoelectric element 158 provided with an individual electrode 157 is bonded to a diaphragm 156 which forms the upper face of the pressure chamber 152 and also serves as a common electrode, and the piezoelectric element 158 is deformed when a drive voltage is supplied to the individual electrode 157, thereby causing ink to be ejected from the nozzle 151. When ink is ejected, new ink is supplied to the pressure chamber 152 from the common flow passage 155, via the supply port 154.

In the present example, a piezoelectric element 158 was used as an ink ejection force generating device which causes ink to be ejected from a nozzle 150 provided in a head 151, but it is also possible to employ a thermal method in which a heater is provided inside the pressure chamber 152 and ink is ejected by using the pressure of the film boiling action caused by the heating action of this heater.

As illustrated in FIG. 9B, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming an angle of θ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the intermediate transfer body 102 is scanned in the breadthways direction of the intermediate transfer body 102, thereby performing printing in the breadthways direction, and when one printing action in the breadthways direction has been completed, the intermediate transfer body 102 is moved through a prescribed amount in the direction perpendicular to the breadthways direction, printing in the breadthways direction of the intermediate transfer body 102 is carried out in the next printing region, and by repeating this sequence, printing is performed over the whole surface of the printing region of the intermediate transfer body 102.

Configuration of a Supply System

Figure 11:
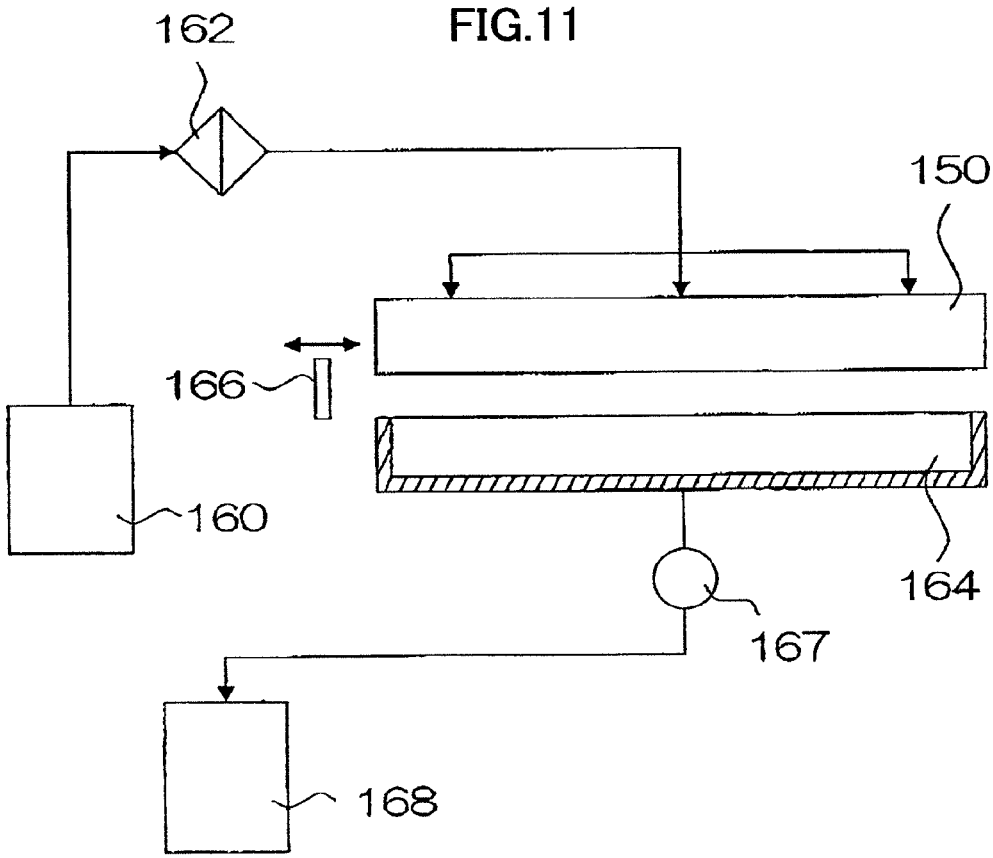
FIG. 11 is a schematic drawing showing the composition of an ink supply system in the inkjet recording apparatus illustrated in FIG. 7.

FIG. 11 is a schematic drawing showing the configuration of the ink supply system in the liquid removing apparatus 10.

The ink supply tank 160 is a base tank that supplies ink to the head 150 and is included in the ink storing and loading unit described with reference to FIG. 7. The aspects of the ink supply tank 160 include a refillable type and a cartridge type: when the remaining amount of ink is low, the ink supply tank 160 of the refillable type is filled with ink through a filling port (not shown) and the ink supply tank 160 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 162 for removing foreign matters and bubbles is disposed between the ink supply tank 160 and the head 150 as illustrated in FIG. 7. The filter mesh size in the filter 162 is preferably equivalent to or less than the diameter of the nozzle and commonly about 20 μm.

Although not illustrated in FIG. 11, it is preferable to provide a sub-tank integrally to the print head 150 or nearby the head 150. The sub-tank has a damper function for preventing variation in the internal pressure of the head and a function for improving refilling of the print head.

The liquid removing apparatus 10 is also provided with a cap 164 as a device to prevent the nozzles 151 from drying out or to prevent an increase in the ink viscosity in the vicinity of the nozzles 151, and a cleaning blade 166 as a device to clean the ink ejection surface of the head 150.

A maintenance unit including the cap 164 and the cleaning blade 166 can be relatively moved with respect to the head 150 by a movement mechanism (not shown), and is moved from a predetermined holding position to a maintenance position below the head 150 as required.

The cap 164 is displaced up and down relatively with respect to the head 150 by an elevator mechanism (not shown). When the power of the liquid removing apparatus 10 is turned OFF or when in a print standby state, the cap 164 is raised to a predetermined elevated position so as to come into close contact with the head 150, and the nozzle face is thereby covered with the cap 164.

During printing or standby, if the use frequency of a particular nozzle 151 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 151, even if the actuator 158 is operated.

Therefore, before a situation of this kind develops (namely, while the ink is within a range of viscosity which allows it to be ejected by operation of the actuator 158), the actuator 158 is operated, and a preliminary ejection ("purge", "blank ejection", "liquid ejection" or "dummy ejections") is carried out toward the cap 164 (ink receptacle), in order to expel the degraded ink (namely, the ink in the vicinity of the nozzle which has increased viscosity).

It is also possible to adopt a mode in which preliminary ejection is performed by ejecting droplets of ink toward the intermediate transfer body 102. For example, if a plurality of images are formed in a continuous fashion, then it is possible to carry out preliminary ejection between the images. In particular when a plurality of copies of the same image are formed, then the frequency of ejection of ink (treatment liquid) becomes low in particular nozzles, and there is an increased possibility that ejection abnormalities will occur; therefore, it is desirable to carry out preliminary ejection between images in respect of these particular nozzles.

If preliminary ejection is performed onto the intermediate transfer body 102, then the heating roller 112A is moved and a prescribed clearance (for example, approximately 10 mm) is provided between the heating roller 112A and the intermediate transfer body 102, in such a manner that the ink deposited by the preliminary ejection does not adhere to the heating roller 112A.

Furthermore, if air bubbles enter into the ink inside the head 150 (inside the pressure chamber 152), then even if the actuator 158 is operated, it will not be possible to eject ink from the nozzle. In a case of this kind, the cap 164 is placed on the head 150, the ink (ink containing air bubbles) inside the pressure chamber 152 is removed by suction, by means of a suction pump 167, and the ink removed by suction is then supplied to a recovery tank 168.

This suction action entails the suctioning of degraded ink whose viscosity has increased (hardened) also when initially loaded into the head, or when service has started after a long period of being stopped. Since the suction operation is carried out with respect to all of the ink inside the pressure chamber 152, the ink consumption is considerably large. Therefore, desirably, preliminary ejection is carried out when the increase in the viscosity of the ink is still minor.

The cleaning blade 166 is composed of rubber or another elastic member, and can slide on the ink ejection surface of the head 150 by means of a blade movement mechanism (not illustrated). If ink droplets or foreign material become attached to the ink ejection surface, then the ink ejection surface is wiped and thereby cleaned, by moving the cleaning blade 166 over the ink ejection surface.

If preliminary ejection is carried out between images, then by using the intermediate transfer body 102 as an ink receptacle, the time required for moving the cap 164 to a position directly below the print unit 108 (see FIG. 7) or the time required to withdraw the intermediate transfer body 102 from directly below the print unit 108 can be saved, and therefore the time required for preliminary ejection can be shortened. Moreover, it is also possible to clean the ink adhering to the intermediate transfer body 102 due to preliminary ejection, by means of the cleaning processing unit. If preliminary ejection is performed onto the intermediate transfer body 102, then the pressurization roller 112B should be separated from the intermediate transfer body 102 in order to prevent the pressurization roller 112B from becoming soiled with ink.

Description of Control System

Figure 12:
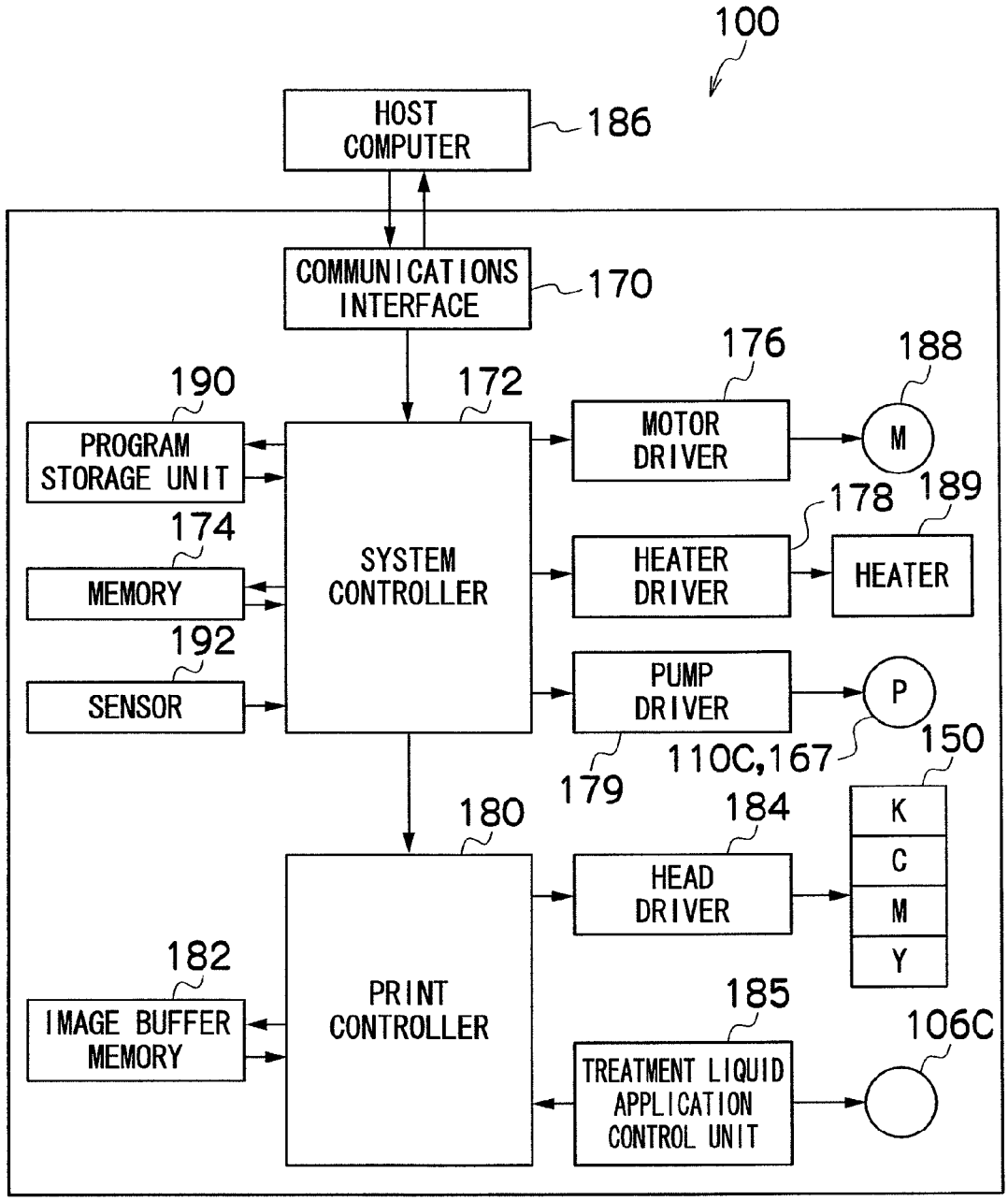
FIG. 12 is a principal block diagram showing a system configuration of the inkjet recording apparatus illustrated in FIG. 7.

FIG. 12 is a principal block diagram showing the system configuration of the inkjet recording apparatus 100. The inkjet recording apparatus 100 comprises a communications interface 170, a system controller 172, a memory 174, a motor driver 76, a heater driver 178, a print controller 180, an image buffer memory 182, a head driver 184, and the like. Moreover, as illustrated in FIG. 12, a pump driver 179, a treatment liquid application control unit 185, a sensor 192, and a transfer recording control unit (not illustrated) are also provided.

The communications interface 170 is an interface unit for receiving image data sent from a host computer 186. A serial interface such as USB (Universal Serial Bus), IEEE1394, Ethernet (registered trademark), wireless network, or a parallel interface such as a Centronics interface may be used as the communications interface 170. A buffer memory (not shown) may be mounted in this portion in order to increase the communication speed. The image data sent from the host computer 186 is received by the inkjet recording apparatus 100 through the communications interface 170, and is temporarily stored in the memory 174.

The memory 174 is a storage device for temporarily storing images inputted through the communications interface 170, and data is written and read to and from the memory 174 through the system controller 172. The memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the liquid removing apparatus 10 in accordance with a prescribed program, as well as a calculation device for performing various calculations. More specifically, the system controller 172 controls the various sections, such as the communications interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-writeable storage device, or it may be a rewriteable storage device, such as an EEPROM. The memory 174 is used as a temporary storage region for the image data, and it is also used as a program development region and a calculation work region for the CPU.

The motor driver 176 drives the motor 188 in accordance with commands from the system controller 172. In FIG. 12, the motors (actuators) disposed in the respective sections of the apparatus are represented by the reference numeral 88. For example, the motor 188 illustrated in FIG. 12 includes a motor which drives the tensioning roller 114A in FIG. 7, a motor which drives the application roller 106C, a motor which drives the liquid absorbing roller 110A of the liquid removal processing unit 110, a motor of the movement mechanism of the pressurization roller 112B, and the like.

The motor contained in the liquid absorbing roller 110A in FIG. 7 includes a motor which rotates the porous roller 16 illustrated in FIG. 1 and a motor which rotates the internal rotating body 20. The rotational speed, and other features, of these motors are controlled by the motor driver 176 on the basis of control signals which are supplied from the system controller 172.

The heater driver 178 drives the heater 189 in accordance with commands from the system controller 172. In FIG. 12, the plurality of heaters which are provided in the inkjet recording apparatus 100 are represented by the reference numeral 189. For example, the heater 189 illustrated in FIG. 12 includes a heater of the preheating unit, a heater which is built into the heating roller 114A illustrated in FIG. 7, and the like.

The pump driver 179 is a functional block which controls the on/off switching and the positive or negative applied pressures of the pump 110C illustrated in FIG. 7 and the pump 167 illustrated in FIG. 11. For example, when the system controller 172 instructs the motor driver 176 to start the operation of the motor of the liquid absorbing roller 110A of the liquid removal processing unit 110, and instructs the pump driver 179 to start the operation of the pump 110C, then on the basis of the instruction signals sent by the system controller 172, the motor of the liquid absorbing roller 110A starts to operate and the pump 110C starts to operate in synchronism with the start of operation of the motor of the liquid absorbing roller 110A.

The print controller 180 has a signal processing function for performing various tasks, compensations, and other types of processing for generating print control signals from the image data stored in the memory 174 in accordance with commands from the system controller 172, and supplies the generated print data (dot data) to the head driver 184. Required signal processing is carried out in the print controller 180, and the ejection amount and the ejection timing of the ink droplets from the respective print heads 150 are controlled via the head driver 184, on the basis of the print data. By this means, desired dot size and dot positions can be achieved.

The print controller 180 is provided with the image buffer memory 182; and image data, parameters, and other data are temporarily stored in the image buffer memory 182 when image data is processed in the print controller 180. Also possible is an aspect in which the print controller 180 and the system controller 172 are integrated to form a single processor.

A transfer recording control unit (not illustrated) controls the pressing force of the pressurization roller 112B in the transfer recording unit 112 illustrated in FIG. 7. The optimal value for the pressing force of the heating roller 112A and the pressurization roller 112B is previously determined for each type of recording medium 104 and each type of ink, and this data is stored in a prescribed memory (for example, the memory 174) in the form of a data table. When information about the recording medium 104 or information about the ink used has been acquired, the pressing force of the pressurization roller 112B is controlled accordingly by referring to the memory. Furthermore, the transfer recording control unit controls the heating temperature of the heater which is incorporated into the heating roller 112A, in accordance with commands from the system controller 172. For example, if the type of recording medium 104 is selected (set) by means of a user interface (not illustrated), then the system controller 172 acquires the information about the recording medium 104, sets the optimal transfer temperature for that recording medium, and issues an instruction signal including the transfer temperature information, to the transfer recording control unit. The transfer recording control unit controls the heating temperature of the heater which is incorporated into the heating roller 112A, in accordance with command signals from the system controller 172.

The head driver 184 generates drive signals to be applied to the piezoelectric elements 158 of the head 150, on the basis of image data supplied from the print controller 180, and also comprises drive circuits which drive the piezoelectric elements 158 by applying the drive signals to the piezoelectric elements 158. A feedback control system for maintaining constant drive conditions in the head 150 may be included in the head driver 184 illustrated in FIG. 12.

The image data to be printed is externally inputted through the communications interface 170, and is stored in the memory 174. In this stage, the RGB image data is stored in the memory 174.

The image data stored in the memory 174 is sent to the print controller 180 through the system controller 172, and is converted to the dot data for each ink color in the print controller 180. In other words, the print controller 180 performs processing for converting the inputted RGB image data into dot data for four colors, K, C, M and Y. The dot data generated by the print controller 180 is stored in the image buffer memory 182.

The primary image formed on the intermediate transfer body 102 must be a mirror image of the secondary image (recorded image) which is to be formed finally on the recording medium 104, taking account of the fact that it is reversed when transferred onto the recording is medium. In other words, the drive signals supplied to the heads 150 are drive signals corresponding to a mirror image, and therefore the input image must be subjected to reversal processing by the print controller 180.

Moreover, the print controller 180 sends a control signal for the application of treatment liquid to the treatment liquid application control unit 185 which controls the treatment liquid application unit 106. For example, the print controller 180 sets a suitable application volume of the treatment liquid in accordance with image data (the total volume of the ink which is ejected as droplets onto the intermediate transfer body 102) and sends this set value for the application volume of treatment liquid to the treatment liquid application control unit. The treatment liquid application control unit controls the application of treatment liquid on the basis of the set value of the treatment liquid application volume sent by the print controller. If an inkjet method is employed in the treatment liquid application unit, then it is possible to adopt a composition similar to that of the head driver 184 for the treatment liquid application control unit.

Various control programs are stored in a program storage section 90, and a control program is read out and executed in accordance with commands from the system controller 172. The program storage section 90 may use a semiconductor memory, such as a ROM, EEPROM, or a magnetic disk, or the like. An external interface may be provided, and a memory card or PC card may also be used. Naturally, a plurality of these storage media may also be provided. The program storage section 90 may also be combined with a storage device for storing operational parameters, and the like (not shown).

In FIG. 12, the various sensors (determination devices) provided in the apparatus are represented by the reference numeral 192. The sensor 192 includes a temperature sensor which determines the temperature of the respective units of the apparatus, a positional sensor which determines the intermediate transfer body 102 (the position of the primary image on the conveyance path), a sensor which determines the amount of ink remaining in the ink supply tank 160 illustrated in FIG. 11.

The determination signals from the sensors 192 illustrated in FIG. 12 are supplied to the system controller 172. Upon acquiring the determination signals sent by the sensors 192, the system controller 172 judges and obtains the various information provided by the determination signals and controls each unit on the basis of this information.

FIG. 12 shows a control system of the inkjet recording apparatus 100 which uses the liquid removal apparatus 10 show in FIG. 1, and a portion of this composition can be used as the control system of the liquid removal apparatus 10 in FIG. 1. For example, a composition which includes the communications interface 170, the system controller 172, the memory 174, the motor driver 176 and the pump driver 179 in FIG. 12 can be used in the control system of the liquid removal apparatus 10.

In the present application example, a mode is shown which uses a pigment-based ink composed by dispersing pigment particles in a solvent, but the present application example may also be applied to a two-liquid system in which a dye-based ink composed of a dye-based coloring material dissolved in a solvent is separated into a coloring material and a solvent by insolubilizing the dye coloring material.

Furthermore, in the present application example, an inkjet recording apparatus which uses a transfer recording system is described as an example, but the present invention can also be applied to an inkjet recording apparatus based on a direct recording system which forms an image on a recording medium by ejecting droplets of ink directly onto a recording medium.

Moreover, in the present application example, an example is described in which the liquid removal apparatus relating to an embodiment of the present invention is applied to a liquid removal processing unit in an inkjet recording apparatus, but the liquid removal apparatus relating to an embodiment of the present invention can also be applied to a recovery device for a carrier liquid in a liquid electrophotographic type of image forming apparatus (for example, a color copying machine).

Although not shown in the drawings, in an electrophotographic type of image forming apparatus, the surface of a photosensitive drum (image carrying body) is charged to a prescribed electric potential, the photosensitive drum is rotated at a prescribed speed of rotation, and an electrostatic latent image is formed on the surface of the photosensitive drum which has been charged. The electrostatic latent image formed on the surface of the photosensitive drum is developed by means of four wet developing apparatuses for the colors of black (K), cyan (C), magenta (M) and yellow (Y) which are disposed in successive fashion about the periphery of the photosensitive drum. The surplus amount of the developer liquid attached to the surface of the photosensitive drum after developing is removed before forming the toner image, and the developer liquid of the photosensitive drum is thereby adjusted to a suitable amount.

The liquid removal apparatus according to an embodiment of the present invention can be used in processing for removing the surplus developer liquid. In other words, the excess developer liquid on the surface of the photosensitive drum is absorbed and removed by placing the surface of a liquid removal roller in contact with the surface of the photosensitive drum. In an image forming apparatus which is based on an electrophotographic method, a conductive polyurethane or a conductive fluorine rubber, or the like, which has conductive properties of a resistance of $10^{10}$ Ω cm or lower (and desirably, $10^{6}$ Ωcm or greater and $10^{9}$ Ωcm or lower) is used for the porous roller.

On the other hand, the recording medium is wrapped electrostatically about the surface of the transfer roller, and is guided to the transfer position. The developer liquid of the first color is transferred to a transfer sheet by means of a transfer corotron. Thereupon, latent images of the second color, third color and fourth color are formed, developed and transferred in a similar fashion, and in this way a four color KCMY toner image is formed on the recording medium which is held on the transfer roller. Thereupon, the recording medium on which the four-color toner image has been formed is separated from the transfer roller and is output to the exterior of the apparatus after being subjected to a fixing process. The toner and developer liquid remaining on the surface of the photosensitive drum is subjected to a cleaning process by means of a cleaning processing unit such as a cleaning blade, and furthermore, the photosensitive drum is subjected to a charge removal process.

According to the application examples described above, in an image forming apparatus which forms a desired image on a recording medium by using ink or a wet toner, or the like, it is possible to remove excess solvent in a suitable fashion, even in cases where excess solvent (liquid) is left remaining on the intermediate transfer body photosensitive drum) or the recording medium.

In the application examples described above, the liquid removal apparatus 10 illustrated in FIG. 1 is applied to the liquid removal processing unit 110 in FIG. 7, but liquid removal apparatuses according to embodiments of the present invention can also be applied broadly to various types of apparatuses which comprise a processing device for removing liquid on a substrate (medium), other than an image forming apparatus such as an inkjet recording apparatus.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid removal apparatus which removes liquid on a base material, the liquid removal apparatus comprising:

an absorbing member which has a hollow cylindrical shape, is composed to be able to rotate around an axis of rotation being a central axis of the hollow cylindrical shape, and absorbs and removes the liquid on the base material by making contact with or by approaching to the liquid;

an internal rotating body which has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body;

a pressure reducing device which is connected to the opening section of the internal rotation body and reduces pressure of the hollow portion of the absorbing member;

an internal rotating body drive device which causes the internal rotating body to rotate relatively with respect to the absorbing member;

a movement device which causes relative movement of the base material with respect to the absorbing member and the internal rotating body; and an internal rotating body drive control device which controls the internal rotating body drive device in such a manner that:

number $N_1$ of rotations per unit time of the absorbing member (where $N_1 \neq 0$), number $N_2$ of rotations per unit time of the internal rotating body (where $N1 \neq N2$ and $N_2 \neq 0$), and a shortest time $T_1$ until an amount of the liquid absorbed by the absorbing member reaches an upper limit of a liquid absorbing capability of the absorbing member, satisfy a following relationship:

$$1/|N_1-N_2|>T_1,$$

and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship:

$$T_2>T_3.$$

2. The liquid removal apparatus as defined in claim 1, further comprising an absorbing member drive device which causes the absorbing member to rotate around the axis of rotation being the central axis of the hollow cylindrical shape, wherein the absorbing member drive device and the internal rotating body drive device are driven by means of a common drive source.

3. The liquid removal apparatus as defined in claim 1, further comprising a wiping member which is provided on the outer circumferential surface of the internal rotating body, and wipes an inner surface of the absorbing member.

4. The liquid removal apparatus as defined in claim 3, wherein the plurality of wiping members have a length corresponding to a length in a lengthwise direction of the internal rotating body, and are provided on both sides of the opening section in terms of a direction of rotation of the internal rotating body.

5. The liquid removal apparatus as defined in claim 1, wherein a gap is provided between an inner surface of the absorbing member and the outer circumferential surface of the internal rotating body.

6. The liquid removal apparatus as defined in claim 1, wherein the absorbing member and the internal rotating body are able to rotate independently of each other.

7. An image forming apparatus, comprising:

an image forming liquid deposition device which deposits an image forming liquid on an image forming medium;

an absorbing member which has a hollow cylindrical shape, is composed to be able to rotate around an axis of rotation being a central axis of the hollow cylindrical shape, and absorbs and removes a liquid component on the image forming medium by making contact with or approaching to the liquid component;

an internal rotating body which has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body;

a pressure reducing device which is connected to the opening section of the internal rotation body and reduces pressure of the hollow portion of the absorbing member;

an internal rotating body drive device which causes the internal rotating body to rotate relatively with respect to the absorbing member;

a movement device which causes relative movement of the image forming medium with respect to the absorbing member and the internal rotating body; and an internal rotating body drive control device which controls the internal rotating body drive device in such a manner that:

number $N_1$ of rotations per unit time of the absorbing member (where $N_1 \neq 0$), number $N_2$ of rotations per unit time of the internal rotating body (where $N1 \neq N2$ and $N_2 \neq 0$), and a shortest time $T_1$ until an amount of the liquid absorbed by the absorbing member reaches an upper limit of a liquid absorbing capability of the absorbing member, satisfy a following relationship:

$$1/|N_1-N_2|>T_1,$$

and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship:

$$T_2>T_3.$$

8. The image forming apparatus as defined in claim 7, further comprising a treatment liquid deposition device which deposits onto the image forming medium a treatment liquid which reacts with the image forming liquid to separate the image forming liquid into a liquid component and an aggregated or insolubilized component.

9. The image forming apparatus as defined in claim 7, wherein the image forming liquid includes an ink containing a coloring material.

10. The image forming apparatus as defined in claim 7, further comprising a transfer recording device which transfers and records an image formed on the image forming medium, onto a recording medium.

11. The image forming apparatus as defined in claim 7, wherein the absorbing member and the internal rotating body are able to rotate independently of each other.

12. A liquid removal method of removing liquid on a base material, the liquid removal method comprising the step of, while causing an internal rotating body to rotate relatively with respect to an absorbing member, causing relative movement of the base material with respect to the absorbing member and the internal rotating body, wherein:

the absorbing member has a hollow cylindrical shape, is composed to be able to rotate around an axis of rotation being a central axis of the hollow cylindrical shape, and absorbs and removes the liquid on the base material by making contact with or by approaching to the liquid;

the internal rotating body has a cylindrical shape corresponding to the hollow cylindrical shape of the absorbing member, is disposed inside a hollow portion of the absorbing member, is composed to be able to rotate around an axis of rotation being a central axis of the cylindrical shape, and comprises an opening section in an outer circumferential surface of the internal rotating body; and the internal rotating body is controlled so that the relative movement of the base material with respect to the absorbing member and the internal rotating body is caused to remove the liquid on the base material while pressure of the hollow portion of the absorbing member is reduced via the opening section of the internal rotating body, in such a manner that:

number $N_1$ of rotations per unit time of the absorbing member (where $N_1 \neq 0$), number $N_2$ of rotations per unit time of the internal rotating body (where $N1 \neq N2$ and $N_2 \neq 0$), and a shortest time $T_1$ until an amount of the liquid absorbed by the absorbing member reaches an upper limit of a liquid absorbing capability of the absorbing member, satisfy a following relationship:

$$1/|N_1-N_2|>T_1,$$

and time $T_2$ required for the opening section of the internal rotating body to relatively pass one point on the absorbing member and time $T_3$ required until the liquid on a surface of the absorbing member moves to an inner wall surface of the absorbing member when the pressure of the hollow portion of the absorbing member is reduced to a prescribed pressure, satisfy a following relationship:

$$T_2>T_3.$$

13. The liquid removal method as defined in claim 12, wherein the absorbing member and the internal rotating body are able to rotate independently of each other.

* * * * *